US007169066B2

(12) United States Patent
Sajima

(10) Patent No.: US 7,169,066 B2
(45) Date of Patent: Jan. 30, 2007

(54) GOLF BALL

(75) Inventor: Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/409,102

(22) Filed: Apr. 9, 2003

(65) Prior Publication Data

US 2003/0190979 A1 Oct. 9, 2003

(30) Foreign Application Priority Data

Apr. 9, 2002 (JP) ..... 2002-106216

(51) Int. Cl.
*A63B 37/12* (2006.01)
*A63B 37/14* (2006.01)

(52) U.S. Cl. ..... 473/383; 473/378

(58) Field of Classification Search ..... 473/379–385
See application file for complete search history.

(56) References Cited

U.S. PATENT DOCUMENTS 4,813,677 A 3/1989 Oka et al.
4,936,587 A 6/1990 Lynch et al.
5,080,367 A 1/1992 Lynch et al.
5,292,132 A 3/1994 Oka
5,957,786 A * 9/1999 Aoyama ..... 473/379
6,241,627 B1 * 6/2001 Kasashima et al. ..... 473/384

OTHER PUBLICATIONS

"The Legal Golf Ball," Strictly Golf Balls. Louis Caschera, Jr. Michigan: strictly golf inc., copyright 1998, pp. 16 and 17.*

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

Golf ball 1 has a large number of dimples 2 on its surface. A surface area occupation ratio Y of these dimples 2 is equal to or greater than 75%. A ratio R1 of the diameter of the maximum dimple $d_{max}$ to the diameter D of this golf ball 1 is 11.0% or greater and 18.0% or less. Total number N of the dimples is equal to or less than 320. A ratio R2 of number of dimples 2 having a diameter d accounting for 11.0% or greater and 18.0% or less of the diameter D, occupied in total number N is equal to or greater than 20%. A mean occupation ratio y which is a value calculated by dividing the surface area occupation ratio Y by total number N is equal to or greater than 0.22%. A summation X of the contour length x of the dimples 2 and the surface area occupation ratio Y satisfy the relationship represented by the following formula (I).

$$X \leqq 38.82 \cdot Y + 1495 \quad \text{(I)}$$

17 Claims, 21 Drawing Sheets

GOLF BALL

BACKGROUND OF THE INVENTION

1. Field of the Invention

The present invention relates to golf balls. More particularly, the present invention relates to the improvement of a dimple pattern of a golf ball.

2. Description of the Related Art

Golf balls have a large number of dimples on their surfaces. A role of the dimples involves causing turbulent flow separation through promoting the transition of a turbulent flow of a boundary layer by disrupting the air flow around the golf ball during flight. By promoting the transition of a turbulent flow, separation points of air from the golf ball shift backwards leading to the reduction of a drag coefficient (Cd) so that a flight distance of the golf ball is prolonged. In addition, difference of separation points on the upper and lower sides of the golf ball resulting from back spin is increased by the promotion of the transition of a turbulent flow, therefore, lift force that acts on the golf ball is elevated.

Various golf balls that are provided with an improved dimple pattern to which the improvement of the flight performance is intended have been proposed. For example, JP-B-50744/1983 discloses a golf ball having dimples densely arranged so that pitches between the dimples be equal to or less than 1.62 mm as much as possible. Further, JP-A-192181/1987 discloses a golf ball having dimples densely arranged so that new dimples can not be formed having an area greater than the average area, on the land parts that are parts other than the dimples. Moreover, JP-A-347177/1992 discloses a golf ball having dimples significantly densely arranged so that number of the land parts on which a rectangle having a predetermined size can be depicted be equal to or less than 40.

Any of the golf balls disclosed in these known literatures has dimples that are densely arranged. In other words, they have an increased surface are a occupation ratio of the dimples. One skilled in the art acknowledges that a critical factor that influences on effects of the dimples is the surface area occupation ratio.

However, the surface area occupation ratio is not necessarily only one index for supeculating the effects of the dimple. From another aspect in addition to the surface area occupation ratio, there still exists room to study on the amelioration intending to further improvement of the flight performance.

SUMMARY OF THE INVENTION

The golf ball according to the present invention has a large number of dimples on its surface. Surface area occupation ratio Y of these dimples is equal to or greater than 75%. Ratio R1 of the diameter of the maximum dimple $d_{max}$ to the diameter D of the golf ball is 11.0% or greater and 18.0% or less. This golf ball is excellent in a flight performance. Although grounds for the excellent flight performance of this golf ball have not been elucidated in detail, it is speculated that the maximum dimple contributes to the reduction of a drag coefficient (Cd), particularly the reduction of the drag coefficient (Cd) in a high speed area immediately after the impact.

Preferably, a ratio R2 of number of dimples having a diameter d accounting for 11.0% or greater and 18.0% or less of the diameter D of the golf ball, occupied in total number N of the dimples is equal to or greater than 20%. This golf ball achieves more excellent flight performance.

Preferably, total number N of the dimples is equal to or less than 320. This golf ball has a large number of dimples of which size being relatively large. Large size dimples contribute to the improvement of aerodynamic characteristics of the golf ball.

Preferably, a mean occupation ratio y is equal to or greater than 0.22%. This golf ball has a number of dimples of which size being relatively large. Large sized dimples contribute to the improvement of aerodynamic characteristics of the golf ball. The mean occupation ratio y is a value calculated by dividing the surface area occupation ratio Y by total number N of the dimples.

Preferably, a summation X of the contour length x of the dimples (total contour length)and the surface area occupation ratio Y satisfy the relationship represented by the following formula (I).

$$X \leqq 38.82 \cdot Y + 1495 \quad \text{(I)}$$

This golf ball is provided with a dimple pattern in which total contour length X is small contrary to the surface area occupation ratio Y. This golf ball exhibits more excellent flight performance.

DESCRIPTION OF THE PREFERRED EMBODIMENTS

The present invention is hereinafter described in detail with appropriate references to the accompanying drawing according to the preferred embodiments of the present invention.

Figure 1:
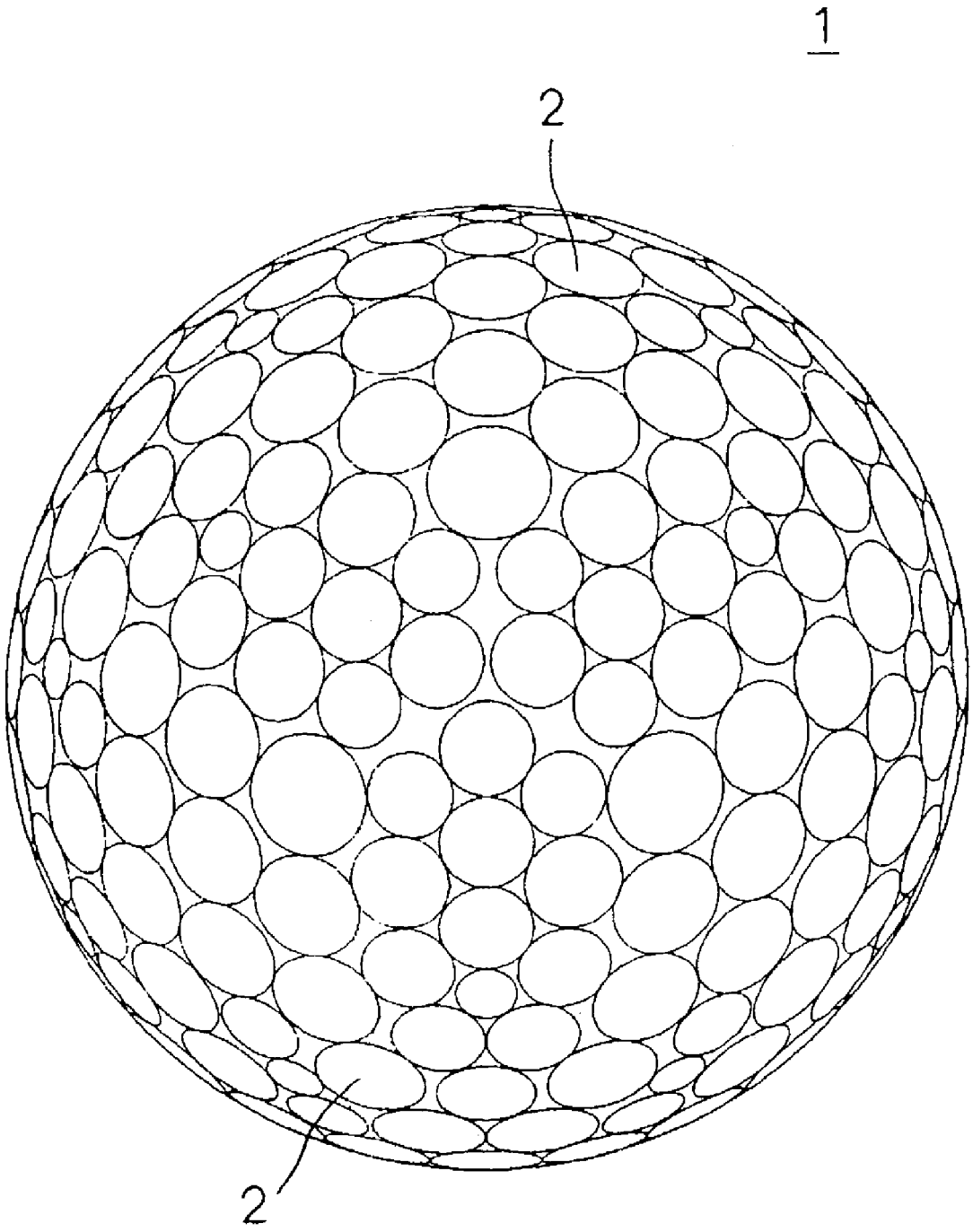
FIG. 1 is a plan view illustrating the golf ball according to one embodiment of the present invention.
Figure 2:
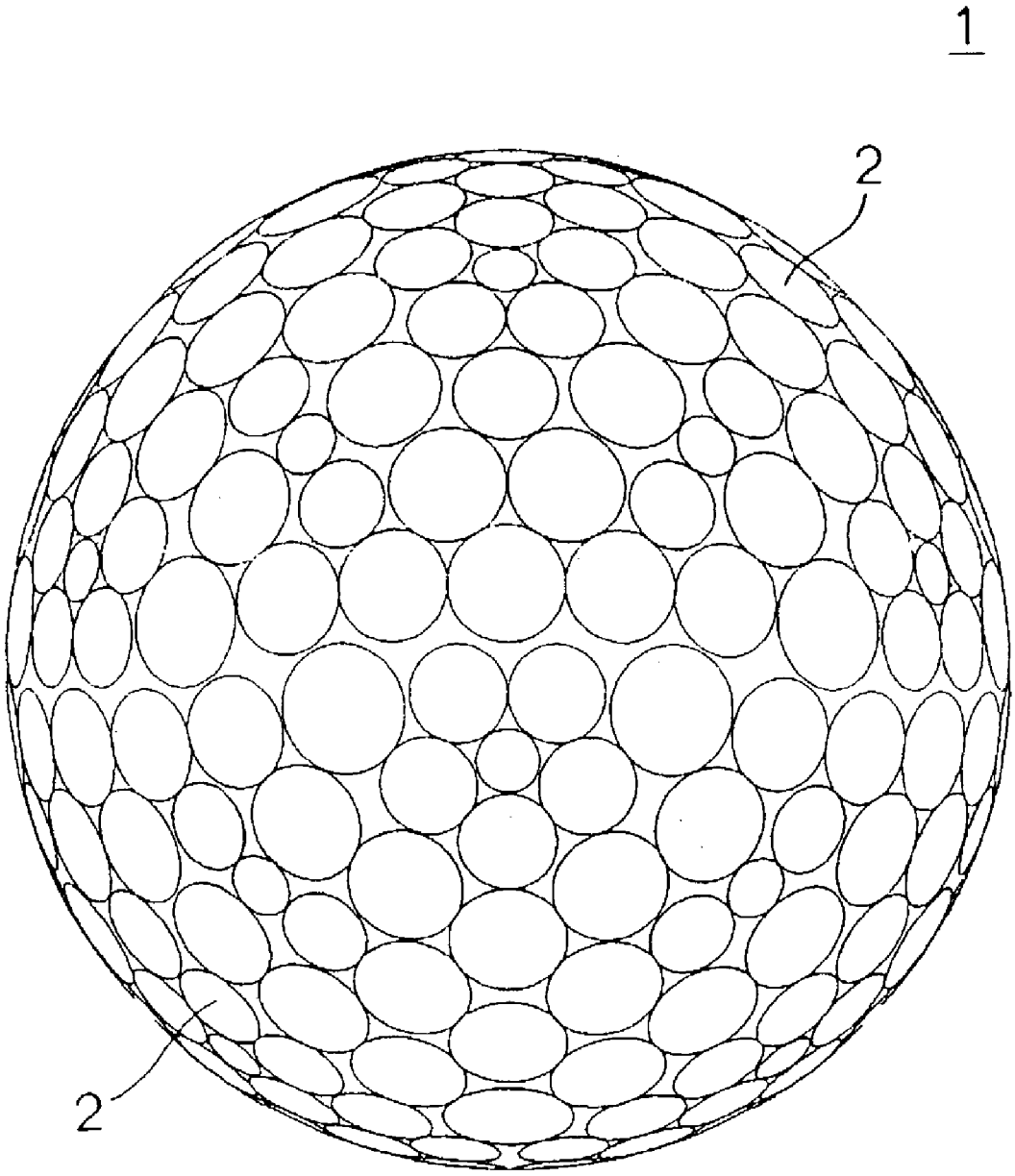
FIG. 2 is a front view illustrating the golf ball shown in FIG. 1.

A golf ball 1 depicted in FIGS. 1 and 2 has a diameter of from 40 mm to 45 mm in general, and in particular, of from 42 mm to 44 mm. In light of the reduction of air resistance in the range to comply with a rule defined by United States Golf Association (USGA), the diameter is preferably 42.67 mm or greater and 42.80 mm or less. Weight of this golf ball 1 is 40 g or greater and 50 g or less, and particularly 44 g or greater and 47 g or less. In light of the elevation of inertia in the range to comply with a rule defined by United States Golf Association, the golf ball 1 preferably has weight of 45.00 g or greater and 45.93 g or less.

This golf ball 1 includes A dimples having a plane shape of circular with a diameter of 5.60 mm, B dimples having a plane shape of circular with a diameter of 5.10 mm, C dimples having a plane shape of circular with a diameter of 4.85 mm, D dimples having a plane shape of circular with a diameter of 4.50 mm, E dimples having a plane shape of circular with a diameter of 4.25 mm, F dimples having a plane shape of circular with a diameter of 3.90 mm, and G dimples having a plane shape of circular with a diameter of 2.75 mm. Number of the A dimple is 18; number of the B dimple is 102; number of the C dimple is 24; number of the D dimple is 18; number of the E dimple is 72; number of the F dimple is 36; and number of the G dimple is 24. Total number N of the dimples of this golf ball 1 is 294.

The maximum dimple herein means the dimple 2 having the largest diameter. In instances of a non-circular dimple, a circular dimple having the same area with the non-circular dimple is envisioned, and the diameter of this circular dimple is assumed as the diameter of the non-circular dimple. The maximum dimple of the golf ball 1 depicted in FIGS. 1 and 2 is the A dimple. In other words, the diameter of the maximum dimple $d_{max}$ is 5.60 mm. Ratio R1 of the diameter of the maximum dimple $d_{max}$ (in this instance, 5.60 mm) to the diameter D of the golf ball 1 (in this instance, 42.70 mm) is 13.1%.

In this golf ball 1, the ratio R1 is greater than those of conventional golf balls. In other words, the maximum dimple is significantly large. This maximum dimple contributes to the aerodynamic characteristics, which impart an excellent flight performance to the golf ball 1. In light of the aerodynamic characteristics, the ratio R1 is set to be equal to or greater than 11.0%. The ratio R1 is more preferably equal to or greater than 12.0%, and particularly preferably equal to or greater than 13.0%. When the ratio R1 is too large, fundamental feature of the golf ball 1 which is a substantially spherical body may be compromised, leading to deteriorated flight performance, or may result in difficulty in rolling of the golf ball 1 on the green. In this respect, the ratio R1 is set to be equal to or less than 18.0%. The ratio R1 is more preferably equal to or less than 17.0%, and particularly preferably equal to or less than 160%.

The dimple 2 having a diameter d accounting for 11.0% or greater and 18.0% or less of the diameter D of the golf ball 1 contributes to the aerodynamic characteristics of the golf ball 1. The ratio R2 of number of dimples 2 having a diameter d accounting for 11.0% or greater and 18.0% or less of the diameter D of the golf ball 1, occupied in total number N of the dimples is preferably equal to or greater than 20%. The golf ball 1 having the ratio R2 of equal to or greater than 20%is excellent in a flight performance. In this respect, the ratio R2 is more preferably equal to or greater than 22%, and particularly preferably equal to or greater than 30%. The ratio R2 is ideally 100%.

In light of the flight performance, it is preferred that all of the dimples 2 have the diameter d accounting for equal to or greater than 5.0%, yet equal to or greater than 5.5%, and particularly equal to or greater than 5.8% of the diameter D of the golf ball 1.

Figure 3:
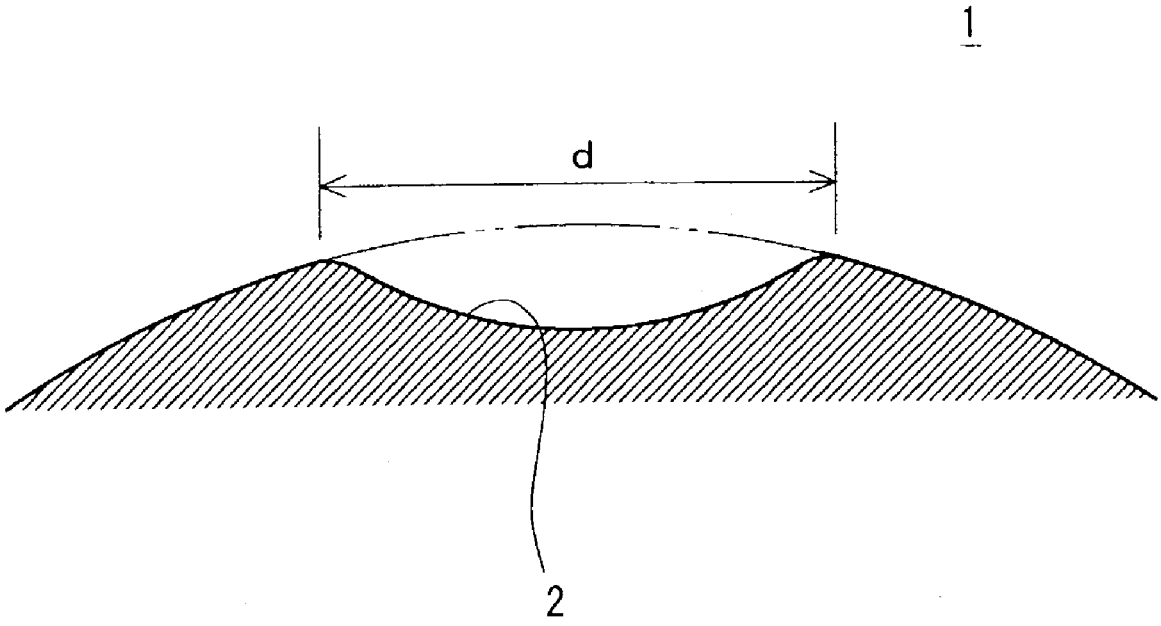
FIG. 3 is a schematic enlarged cross-sectional view illustrating a part of the golf ball shown in FIG. 1.

FIG. 3 is a schematic enlarged cross-sectional view illustrating a part of the golf ball 1 shown in FIG. 1. In this Figure, a cross-section traversing the deepest part of the dimple 2 is illustrated. What is depicted by a both-sided arrowhead d in this Figure is a diameter of the dimple 2. This diameter d is a distance between both contact points when common tangent lines are depicted at both sides of the dimple 2. Further, volume of a space surrounded by a phantom sphere (a sphere when it was postulated that there is no dimple 2, and is depicted by a chain double-dashed line in FIG. 3) of the golf ball 1 and the surface of the dimple 2 is the dimple volume.

The area of the dimple 2 is an area of a region surrounded by the contour of the dimple 2 when the center of the golf ball 1 is viewed at infinity (i.e., an area of the plane shape). In the instance of a circular dimple 2, the area s is calculated by the following formula.

$$s=(d/2)^2\cdot\pi$$

In the golf ball 1 shown in FIG. 1, the area s of the A dimple is 24.63 $mm^2$; the area s of the B dimple is 20.43 $mm^2$; the area s of the C dimple is 18.47 $mm^2$; the area s of the D dimple is 15.90 $mm^2$; the area s of the E dimple is 14.19 $mm^2$; the area s of the F dimple is 11.95 $mm^2$; and the area s of the G dimple is 5.94 $mm^2$. Accordingly, a summation of the dimple areas (total area) S is 4850.7 $mm^2$. The ratio of this total area S to the surface area of the phantom sphere is the surface area occupation ratio Y. According to this golf ball 1, the surface area occupation ratio Y is 84.68%. Mean occupation ratio y is calculated by dividing this surface area occupation ratio Y by total number N of the dimples. According to this golf ball 1, the mean occupation ratio v is 0.288%. The mean occupation ratio y refers to the area ratio of the dimple that have the mean area, occupied in the spherical surface of the phantom sphere.

It is preferred that the surface area occupation ratio Y be equal to or greater than 75%. When the surface area occupation ratio Y is less than the above range, lift force of the golf ball 1 during the flight may be deficient. In this respect, the surface area occupation ratio Y is more preferably equal to or greater than 78%, and particularly preferably equal to or greater than 80%. Common golf ball 1 has the surface area occupation ratio Y of equal to or less than 88%.

In an attempt to design a dimple pattern having a large surface area occupation ratio Y by a designer, there exists a means to achieve such a surface area occupation ratio Y by increasing the total number N of the dimples. Alternatively, there also exists a means to achieve such a surface area occupation ratio Y by increasing the diameter d of the dimples 2. When the designer predominantly employs the means in which such a surface area occupation ratio Y is achieved by increasing the diameter d of the dimples 2, the golf ball 1 having the mean occupation ratio y of equal to or greater than 0.22% can be obtained.

When the mean occupation ratio y is less than 0.22%, the drag coefficient (Cd) in a high speed area in the trajectory track may become so large that the flight distance of the golf ball 1 becomes insufficient. In this respect, the mean occupation ratio y is more preferably equal to or greater than 0.24%, even more preferably equal to or greater than 0.26%, and particularly preferably equal to or greater than 0.28%. The golf ball 1 having a mean occupation ratio y that is excessively large, the fundamental feature of the golf ball which is a substantially spherical body may not be sustained. Therefore, the mean occupation ratio y of common ball 1 is equal to or less than 0.40%.

Total number N of the dimples 2 is preferably equal to or less than 320. When the total number N is beyond the above range, individual dimples 2 become so small that a flight performance of the golf ball 1 may become insufficient. In this respect, total number N is more preferably equal to or less than 310, and particularly preferably equal to or less than 295. From the perspective that the golf ball 1 can be in a substantially spherical shape while keeping the surface area occupation ratio Y of equal to or greater than 75%, it is preferred that total number N is equal to or greater than 210, and particularly equal to or greater than 230.

In the golf ball 1 shown in FIG. 1, the contour length x of the A dimple is 17.59 mm; the contour length x of the B dimple is 16.02 mm; the contour length x of the C dimple is 15.24 mm; the contour length x of the D dimple is 14.14 mm; the contour length x of the E dimple is 13.35 mm; the contour length x of the F dimple is 12.25 mm; and the contour length x of the G dimple is 8.64 mm. According to this golf ball 1, total contour length X that is a summation of the dimple contour length x is 4180.8 mm.

The contour length x of the dimple 2 refers to the length which is actually measured along the contour of the dimple 2. For example, in the instance of a dimple having a triangular plane shape, the summation of length of the three edges corresponds to the contour length x. Because this edge is present on a spherical face, it has an arcuate shape in the strict sense. The length of this arc is assumed as the length of the edge. Furthermore, in the instance of a circular dimple 2, the contour length x is calculated by the following formula.

$$x=d\cdot\pi$$

It is preferred that the surface area occupation ratio Y and total contour length X satisfy the relationship represented by the following formula (I)

$$X\leqq 38.82\cdot Y+1495 \quad \text{(I)}$$

According to this golf ball 1, total contour length X is relatively small contrary to the surface area occupation ratio Y. This golf ball 1 exhibits small drag coefficient (Cd) during flight, and thus is excellent in a flight performance. As long as the present inventor is aware, the golf ball 1 which satisfies the above formula (I) has not been present so far.

In light of the reduction of the drag coefficient (Cd) it is more preferred that total contour length X and the surface area occupation ratio Y satisfy the following formula (II); it is even more preferred that both satisfy the following formula (III); and it is particularly preferred that both satisfy the following formula (IV).

$$X\leqq 38.82\cdot Y+1445 \quad \text{(II)}$$

$$X\leqq 38.82\cdot Y+1335 \quad \text{(III)}$$

$$X\leqq 38.82\cdot Y+1085 \quad \text{(IV)}$$

In order to sustain the fundamental feature of the golf ball which is a substantially spherical body, total contour length X and the surface area occupation ratio Y are required to satisfy the relationship represented by the following formula (V)

$$X\geqq 38.82\cdot Y+95 \quad \text{(V)}$$

Although total contour length X is determined ad libitum on the basis of the relation ship with the surface area occupation ratio Y in the range to satisfy the above formula (I), it is usually 2800 mm or greater and 5000 mm or less, and particularly, 3100 mm or greater and 4700 mm or less.

In light of the reduction of the drag coefficient (Cd), number of the dimples 2 having the contour length x of equal to or greater than 10.5 mm accounts for preferably equal to or greater than 91%, and particularly preferably equal to or greater than 95% of total number of the dimples. This percentage is ideally 100%.

Depth of the dimple 2 (a distance between the phantom spherical face and the deepest part of the dimple 2) is preferably 0.05 mm or greater and 1.00 mm or less. When the depth is less than the above range, transition of a turbent flow hardly occurs. In this respect, the depth is more preferably equal to or greater than 0.10 mm, and particularly preferably equal to or greater than 0.15 mm. When the depth is beyond the above range, the dimples 2 are likely to be filled with mould. In this respect, the depth is more preferably equal to or less than 0.85 mm, and particularly preferably equal to or less than 0.70 mm.

Although the dimples 2 formed may be of only one type, it is preferred that two or more types, particularly three or more types of the dimples having different diameter or depth are formed, in light of a flight performance. In stead of the circular dimples 2, or together with the circular dimples 2, non-circular dimples (dimples of which plane shape is not circular) may be formed. Specific examples of the non-circular dimple include polygonal dimples, elliptical dimples, oval dimples, egg-shaped dimples and the like.

Summation of the dimple volume (total volume) is preferably 400 $mm^3$ or greater and 800 $mm^3$ or less. When the total volume is less than the above range, hopping trajectory may be provided. In this respect, the total volume is more preferably equal to or greater than 450 $mm^3$, even more preferably equal to or greater than 500 $mm^3$, yet even more preferably equal to or greater than 580 $mm^3$, and particularly preferably equal to or greater than 620 $mm^3$. When the total volume is beyond the above range, dropping trajectory may be provided. In this respect, the total volume is more preferably equal to or less than 770 $mm^3$, even more preferably equal to or less than 750 $mm^3$, and particularly preferably equal to or less than 690 $mm^3$.

It is preferred that the golf ball 1 has no great circle path at all. The great circle path means a great circle which does not cross with any of the dimples 2. Upon the molding of the golf ball 1, a mold including upper and lower molds, both of which having a hemisphere cavity is employed. By using a mold having a parting line with uneven shape having concavity and convexity between the upper mold and the lower mold, a golf ball 1 having no great circle path at all can be molded.

Structure of the golf ball 1 is not particularly limited, which may include so-called wound golf balls, or solid golf balls (i.e., one-piece golf balls, two-piece golf balls, three-piece golf balls and the like). The materials are not also particularly limited, and any of known materials can be used.

EXAMPLES

Example 1

A core comprising a solid rubber was placed in a mold, and an ionomer resin composition was injected around the core to form a cover. To the surface of this cover was subjected painting. Accordingly, the golf ball of Example 1 was obtained having a dimple pattern of which plan view is as shown in FIG. 1 and of which front view is as shown in FIG. 2. External diameter of this golf ball was about 42.70 mm, and the weight thereof was about 45.4 g, with compression (measured using ATTI compression tester manufactured by Atti Engineering Co., Ltd.) being about 85.

Examples 2 to 7 and Comparative Examples 1 to 3

Figure 4:
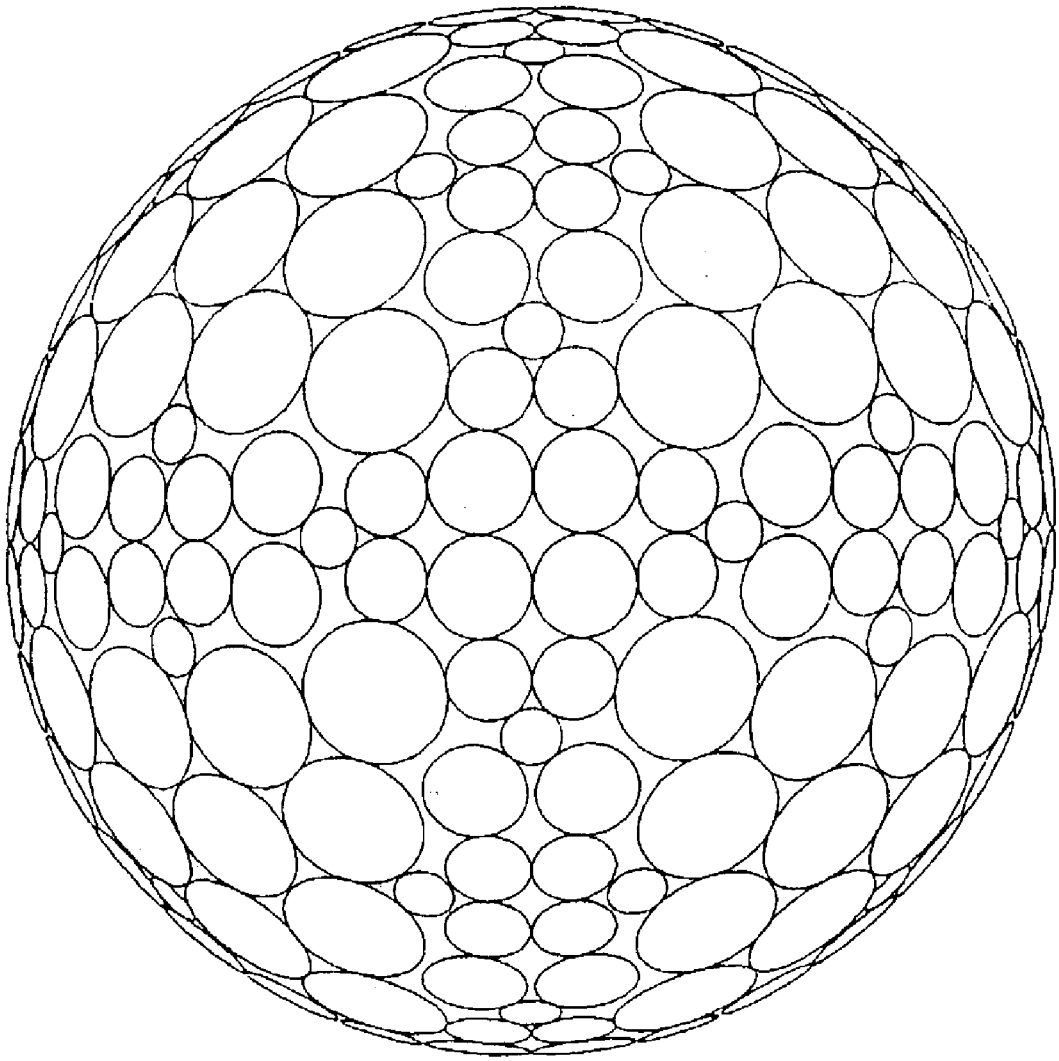
FIG. 4 is a plan view illustrating the golf ball according to Example 2 of the present invention.
Figure 5:
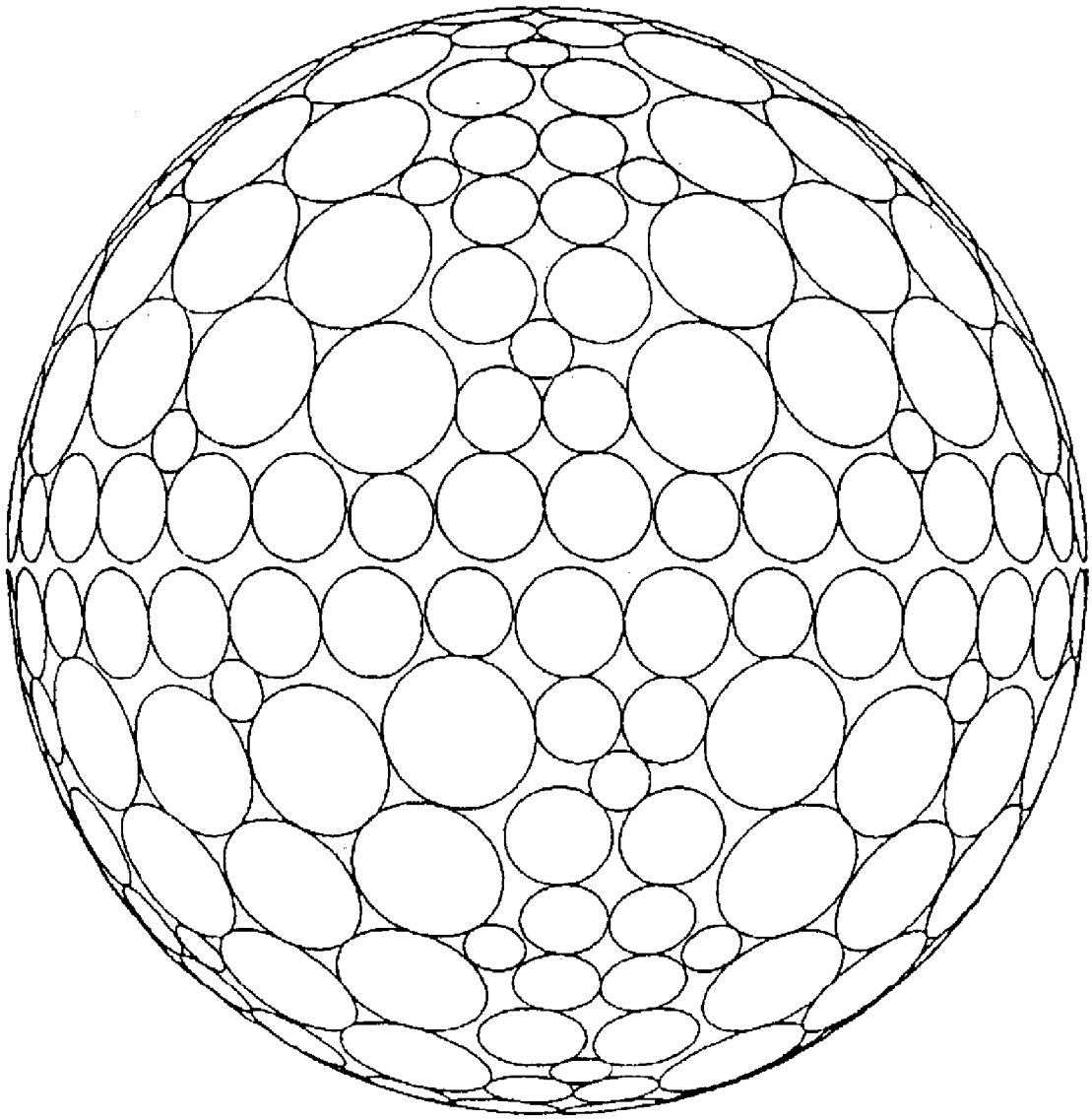
FIG. 5 is a front view illustrating the golf ball shown in FIG. 4.
Figure 6:
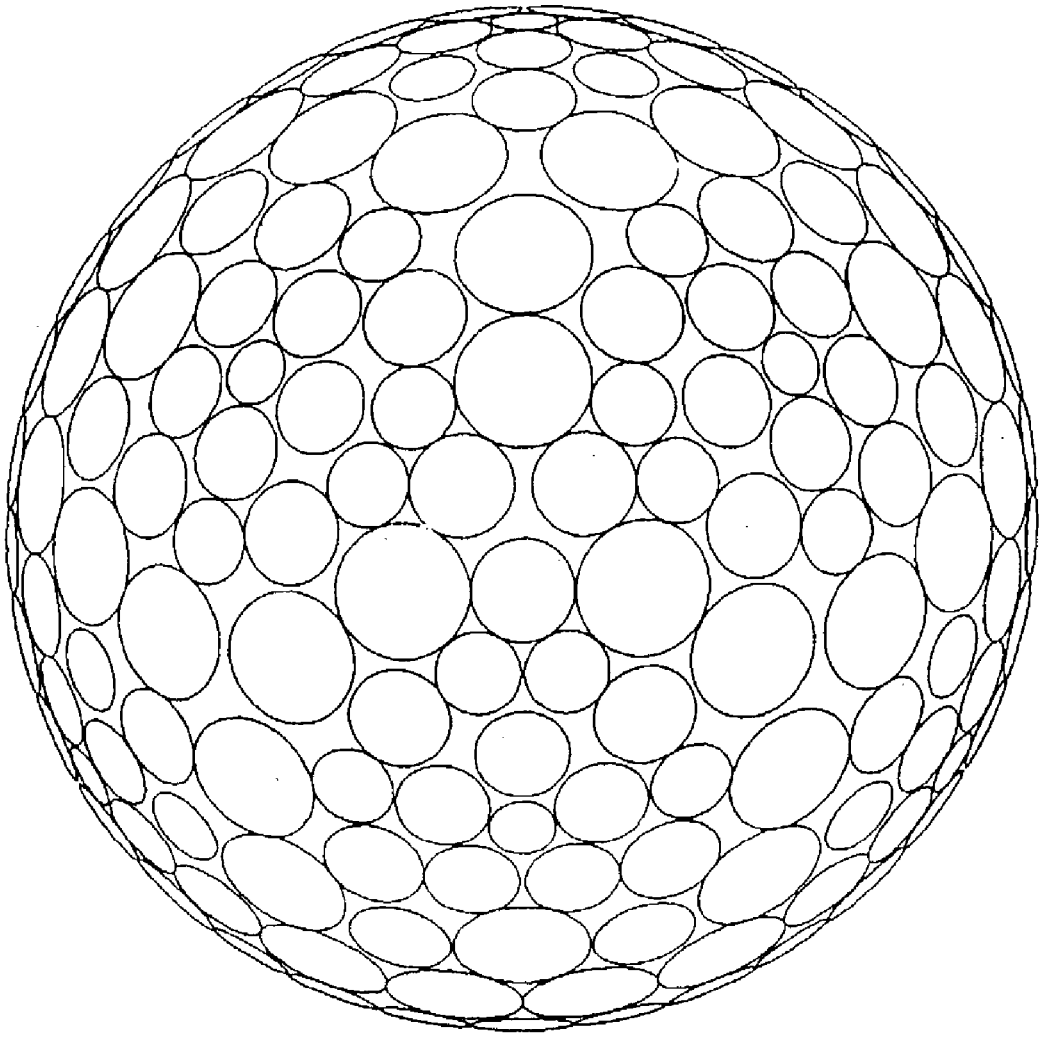
FIG. 6 is a plan view illustrating the golf ball according to Example 3 of the present invention.
Figure 7:
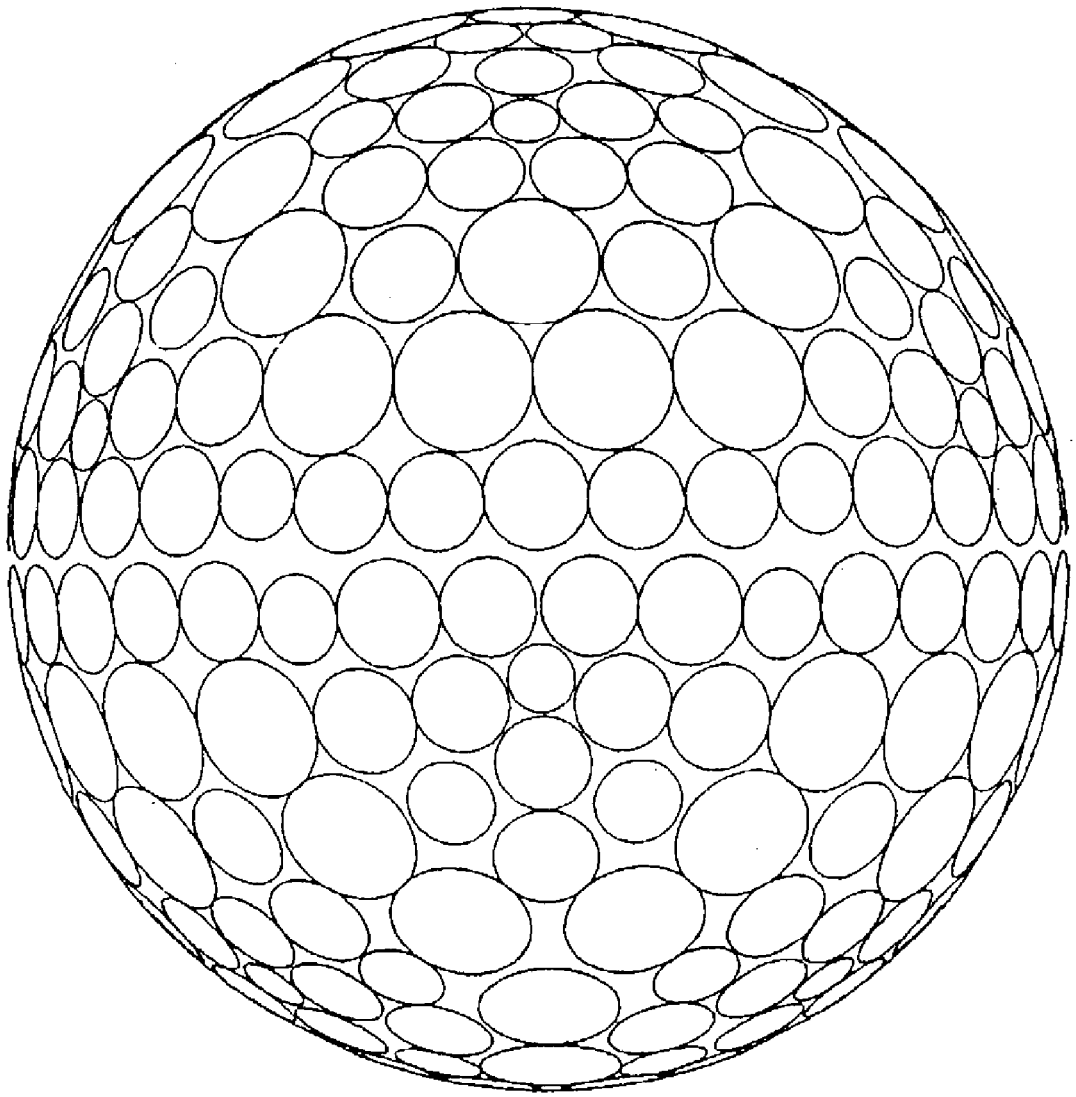
FIG. 7 is a front view illustrating the golf ball shown in FIG. 6.
Figure 8:
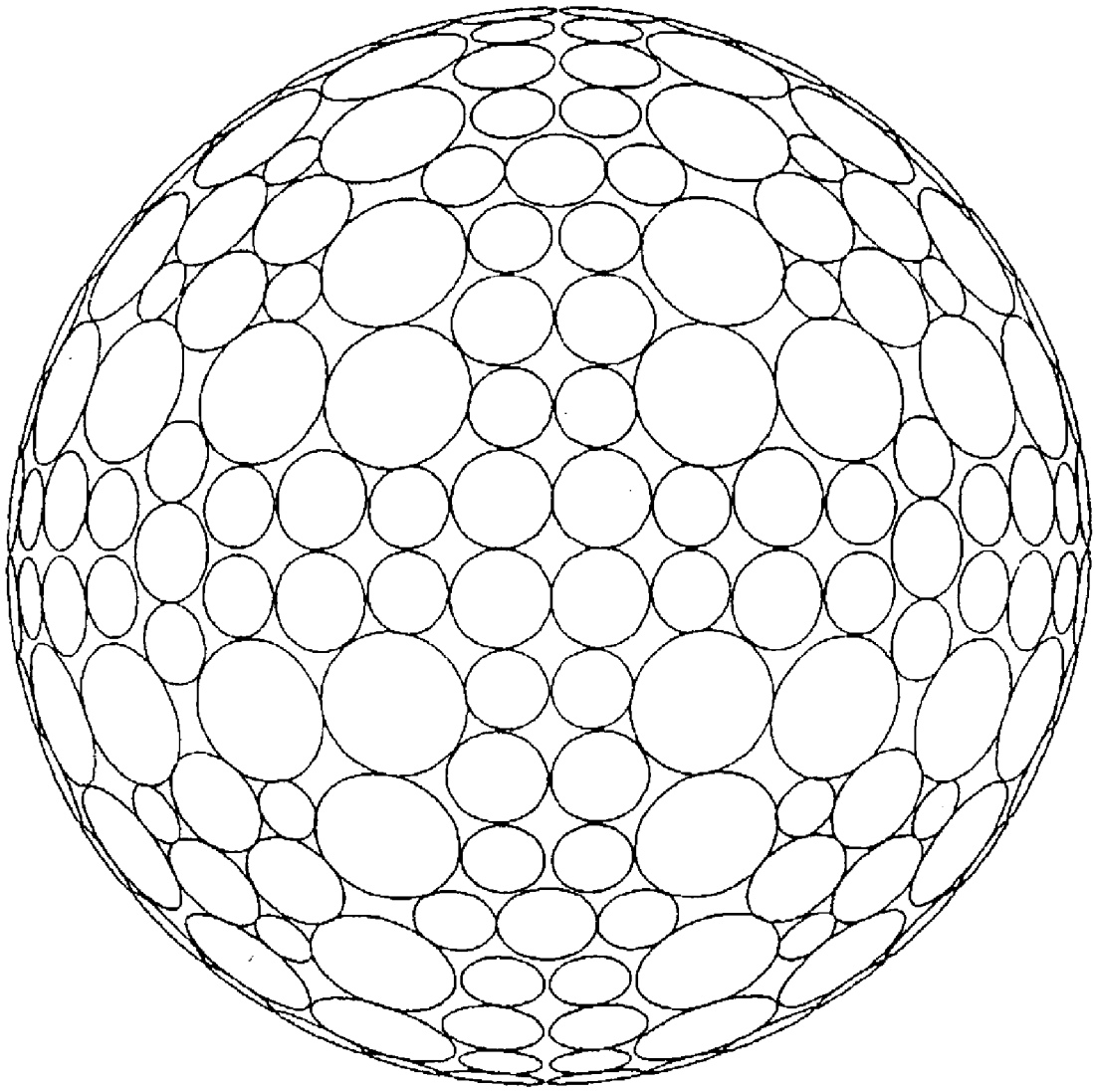
FIG. 8 is a plan view illustrating the golf ball according to Example 4 of the present invention.
Figure 9:
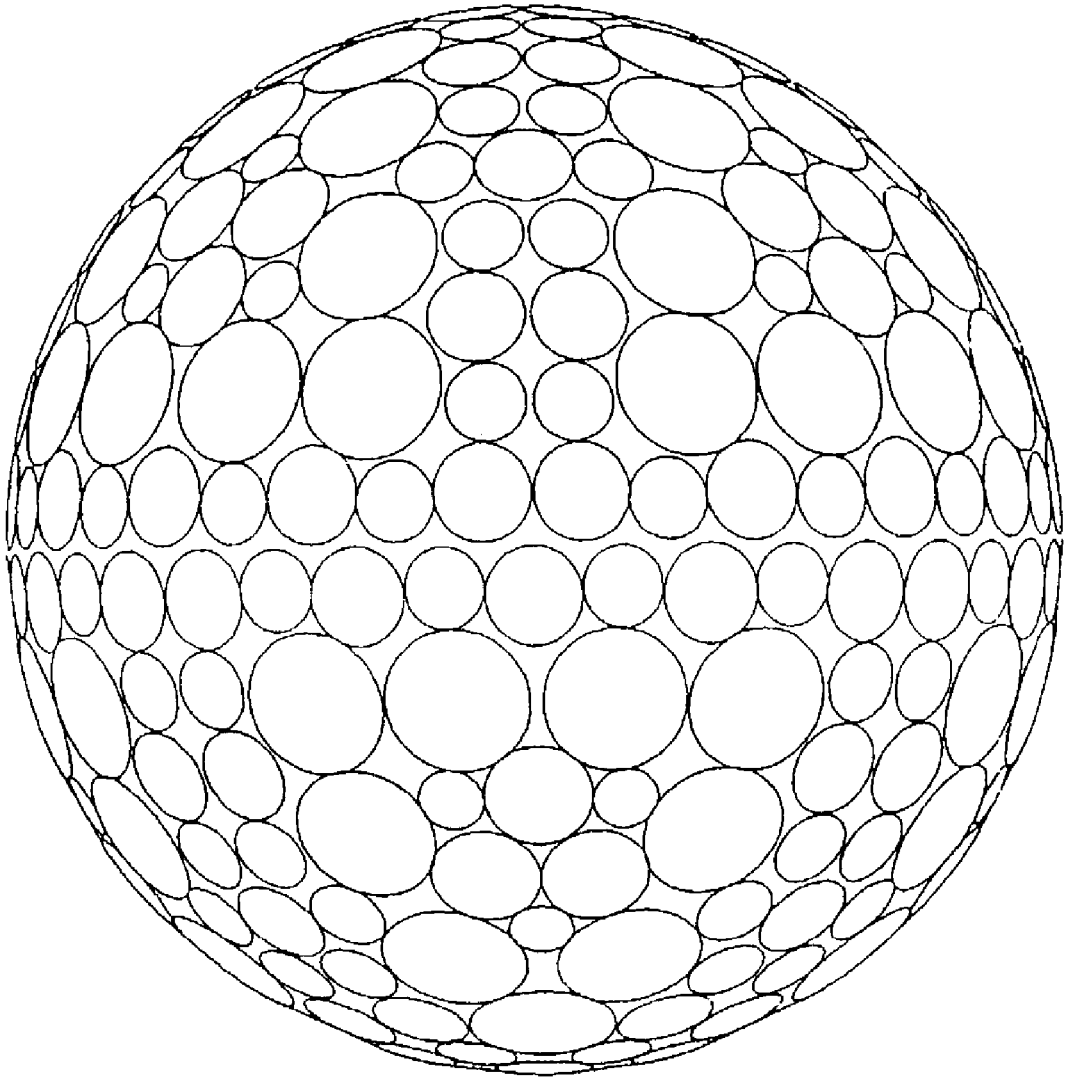
FIG. 9 is a front view illustrating the golf ball shown in FIG. 8.
Figure 10:
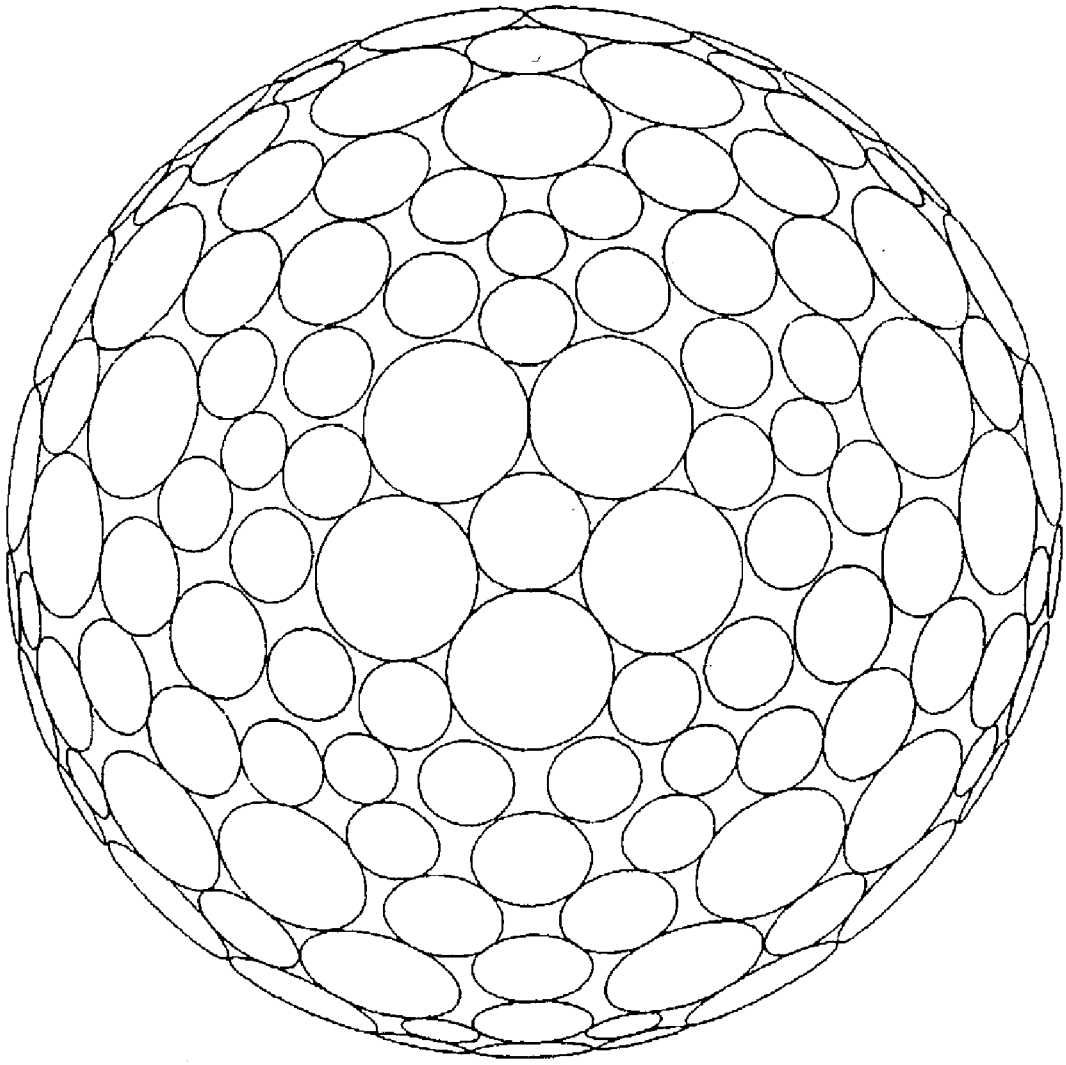
FIG. 10 is a plan view illustrating the golf ball according to Example 5 of the present invention.
Figure 11:
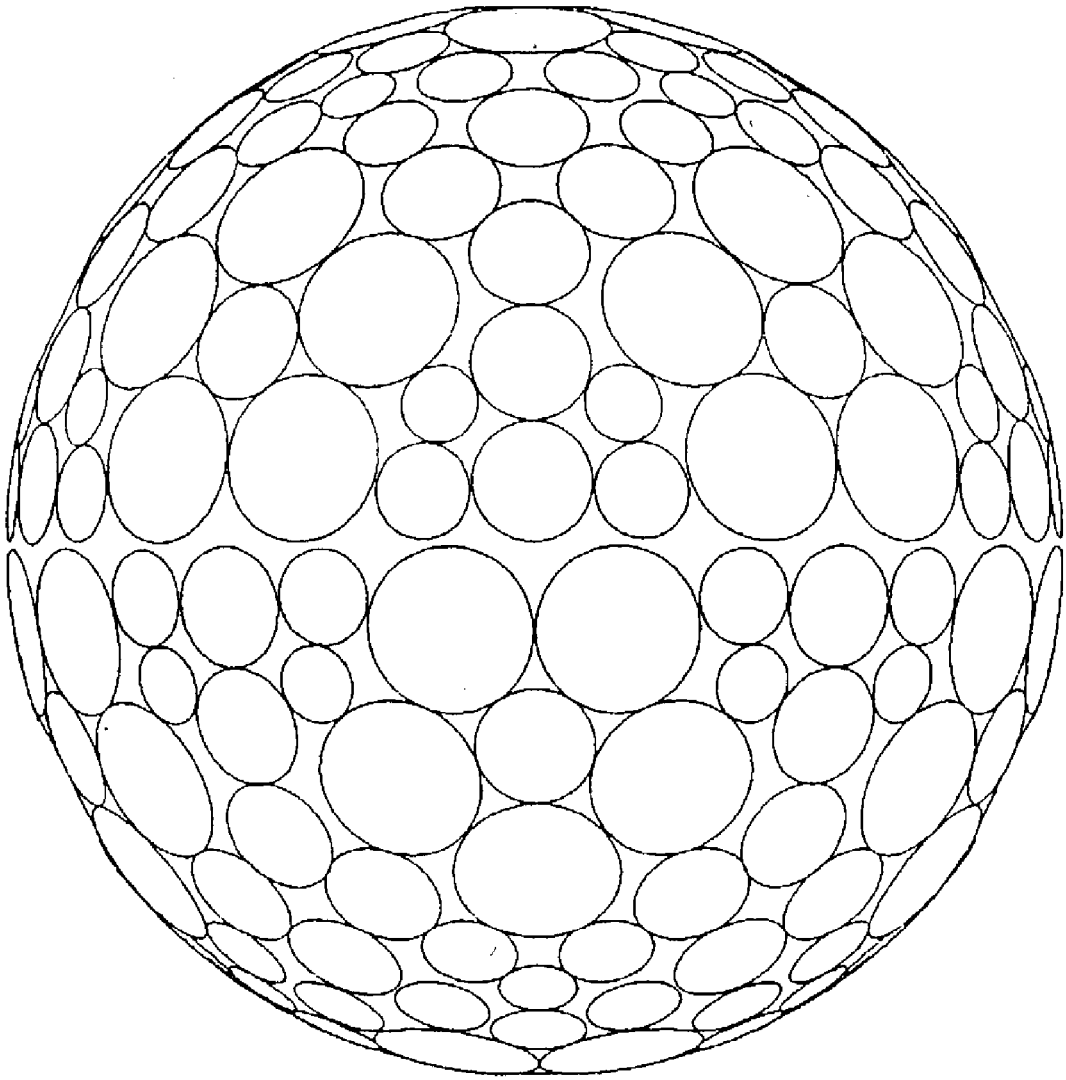
FIG. 11 is a front view illustrating the golf ball shown in FIG. 10.
Figure 12:
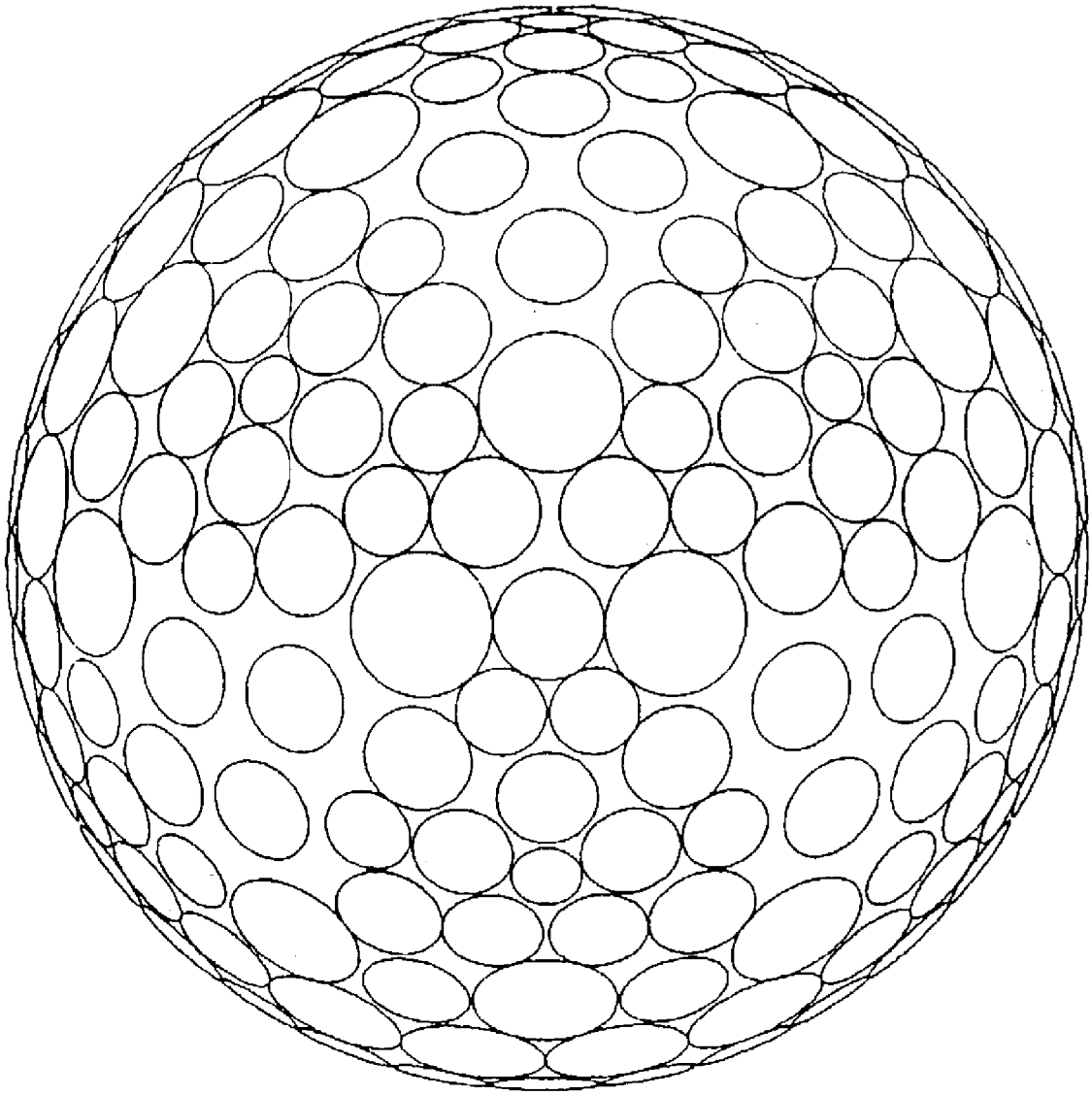
FIG. 12 is a plan view illustrating the golf ball according to Example 6 of the present invention.
Figure 13:
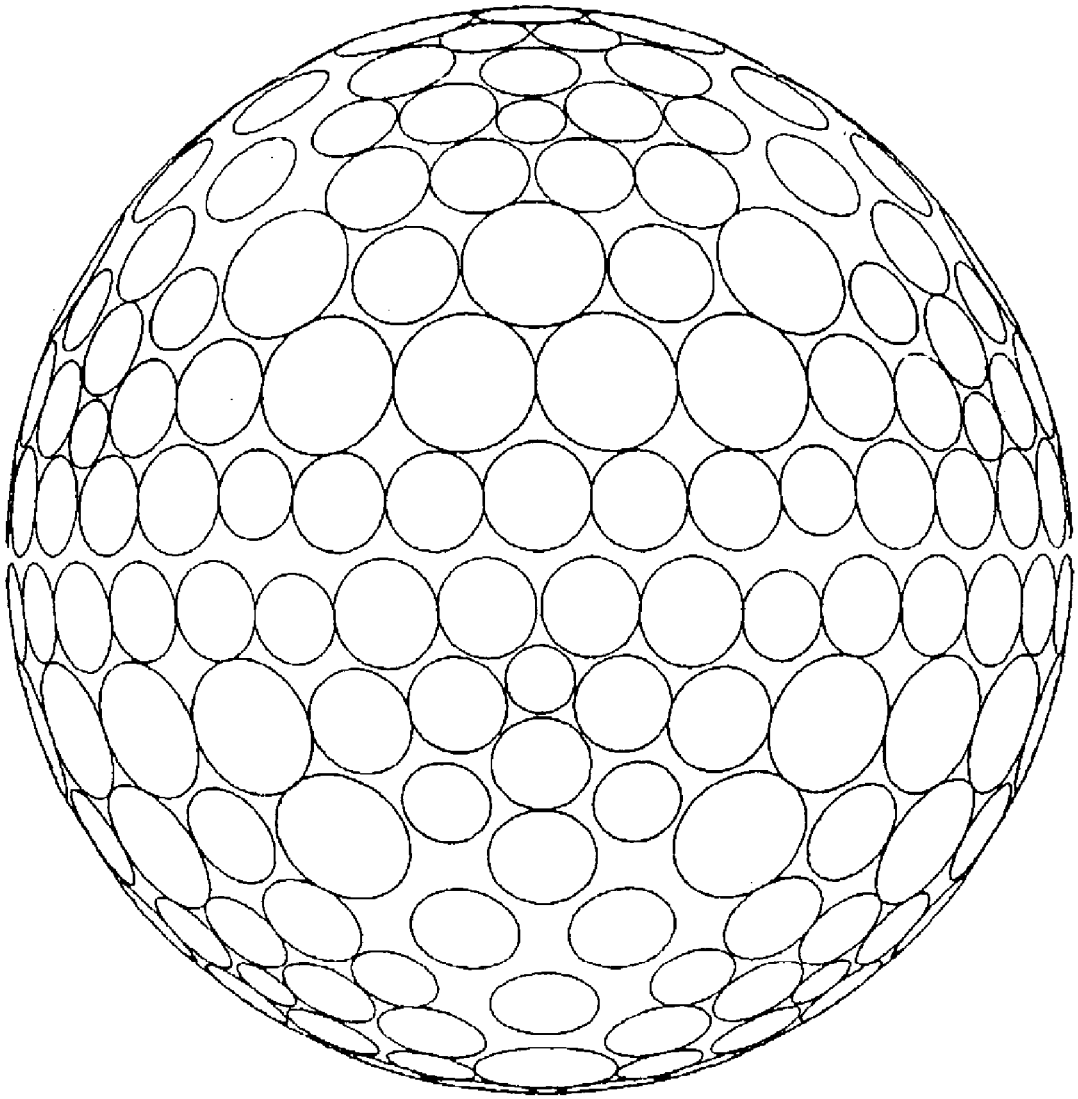
FIG. 13 is a front view illustrating the golf ball shown in FIG. 12.
Figure 14:
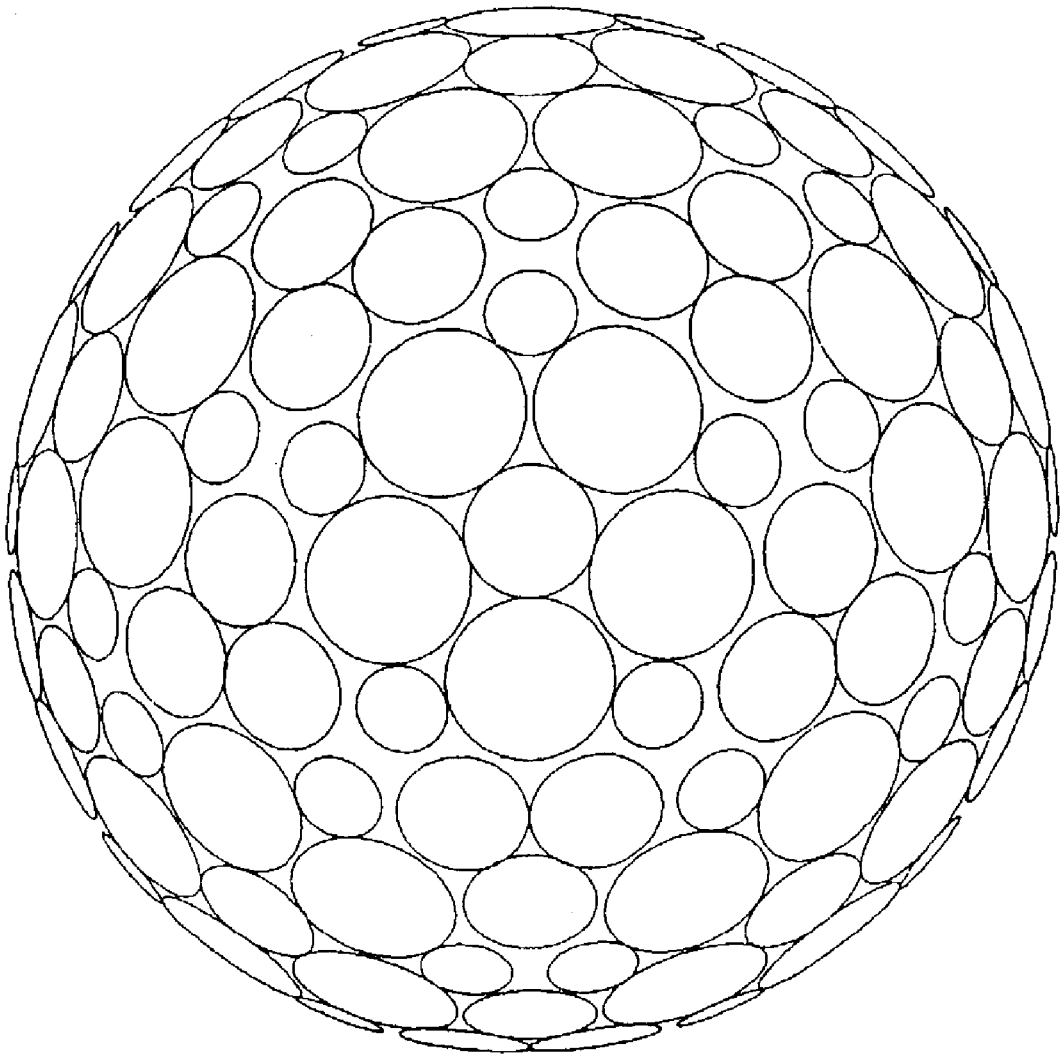
FIG. 14 is a plan view illustrating the golf ball according to Example 7 of the present invention.
Figure 15:
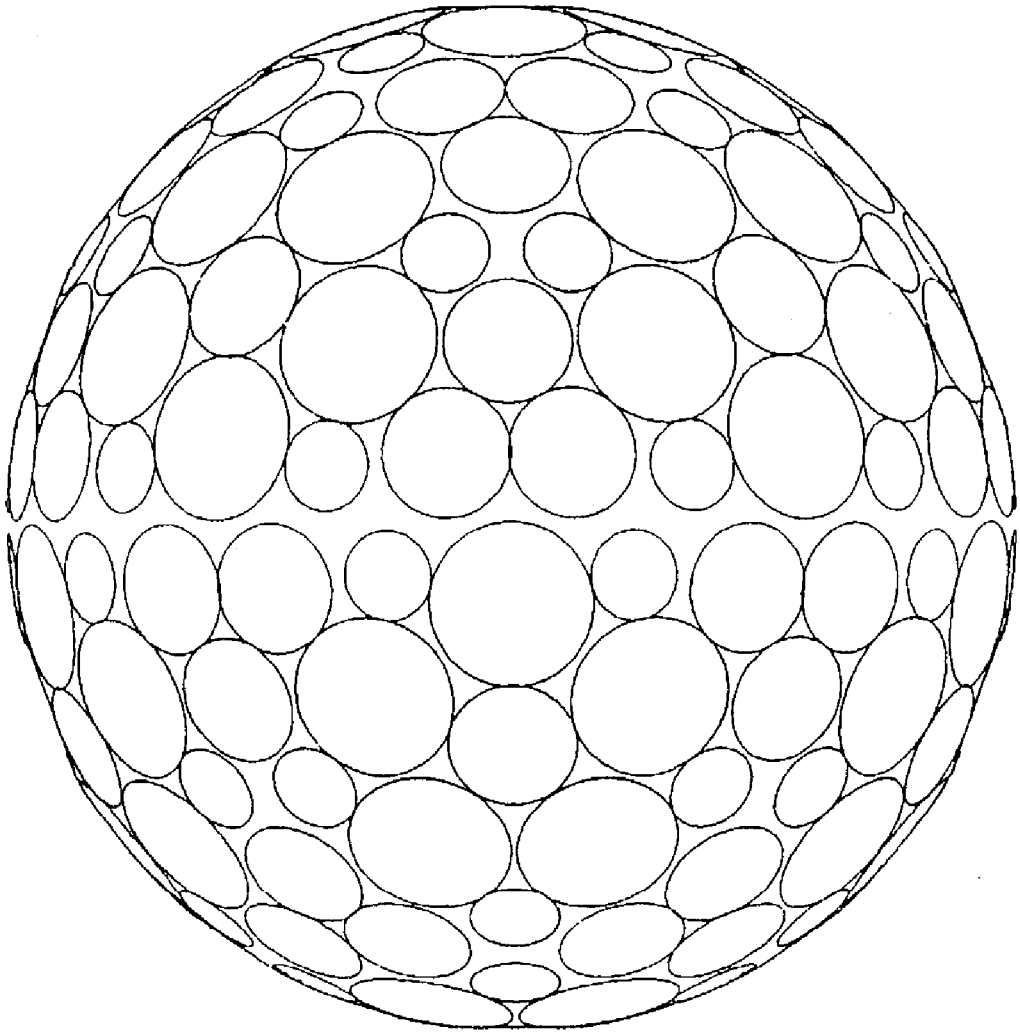
FIG. 15 is a front view illustrating the golf ball shown in FIG. 14.
Figure 16:
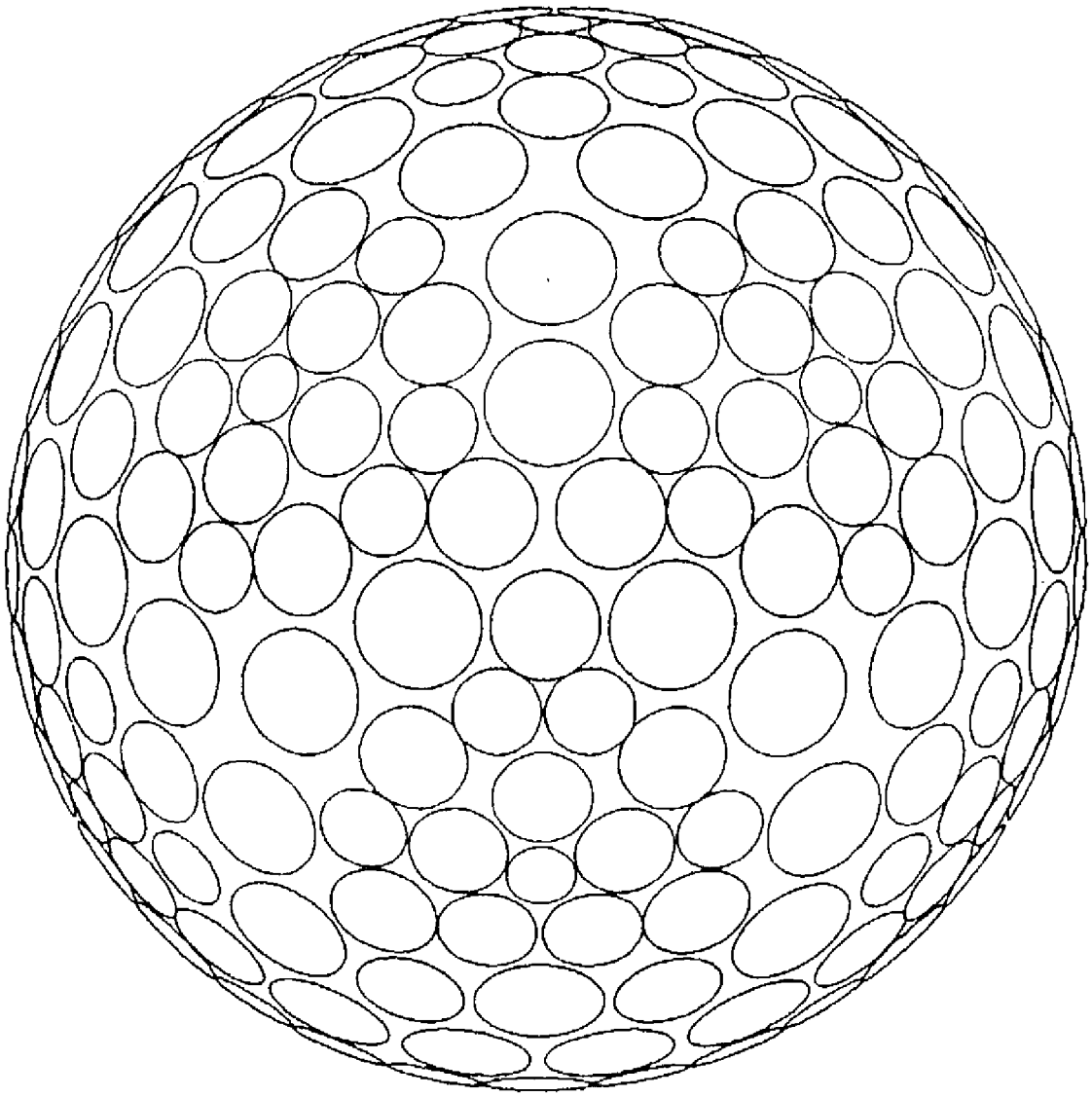
FIG. 16 is a plan view illustrating the golf ball according to Comparative Example 1 of the present invention.
Figure 17:
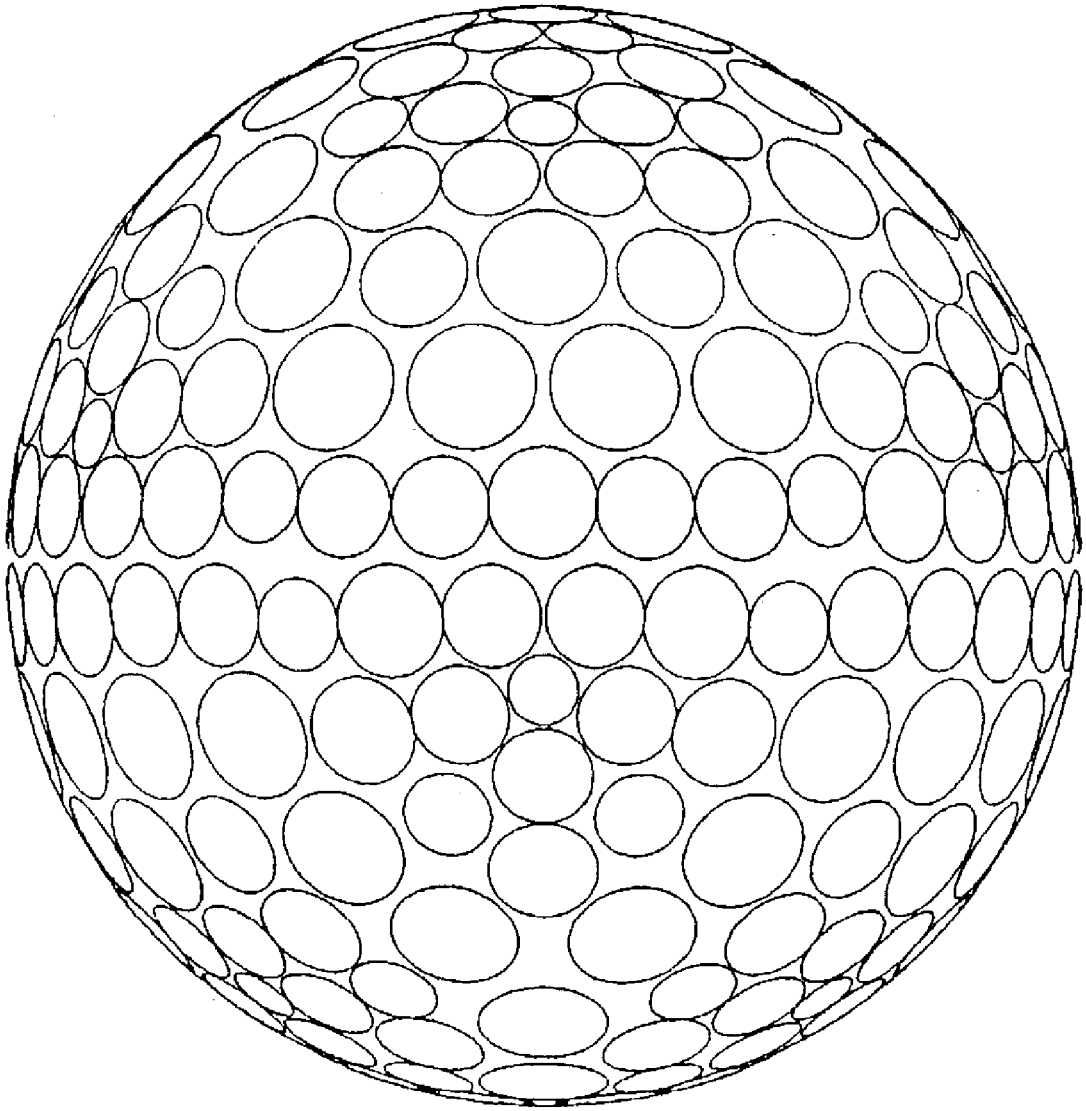
FIG. 17 is a front view illustrating the golf ball shown in FIG. 16.
Figure 18:
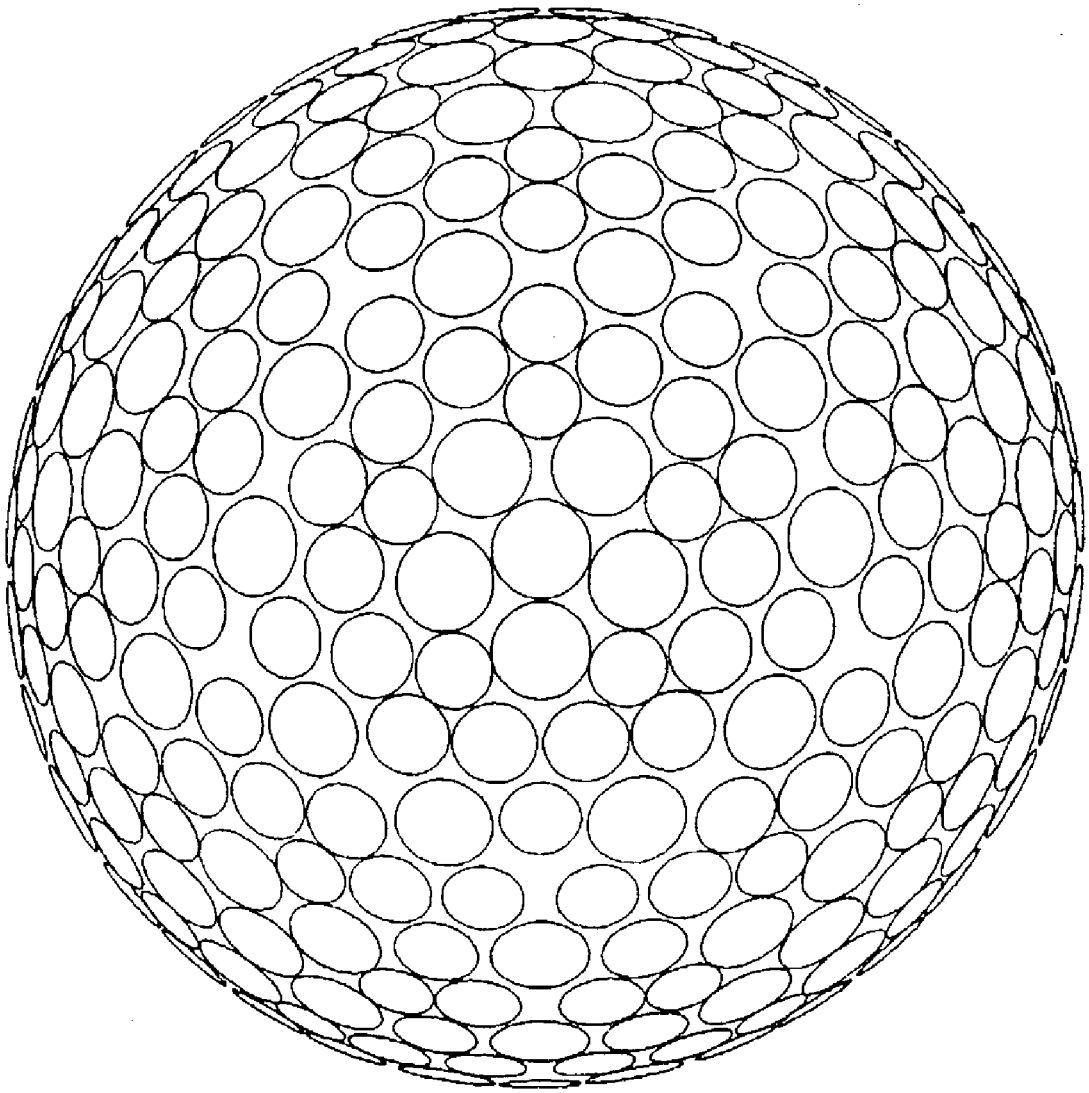
FIG. 18 is a plan view illustrating the golf ball according to Comparative Example 2 of the present invention.
Figure 19:
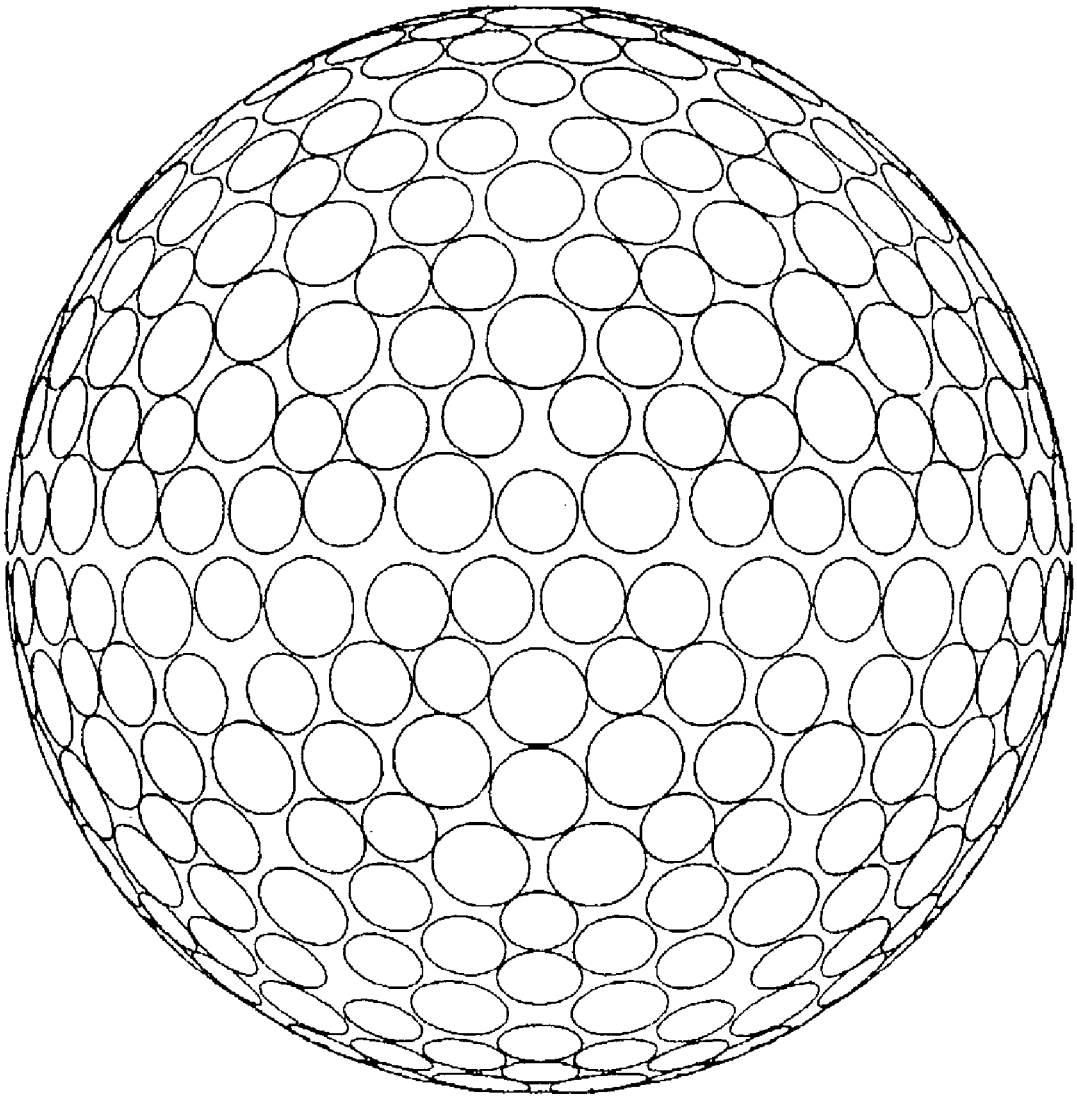
FIG. 19 is a front view illustrating the golf ball shown in FIG. 18.
Figure 20:
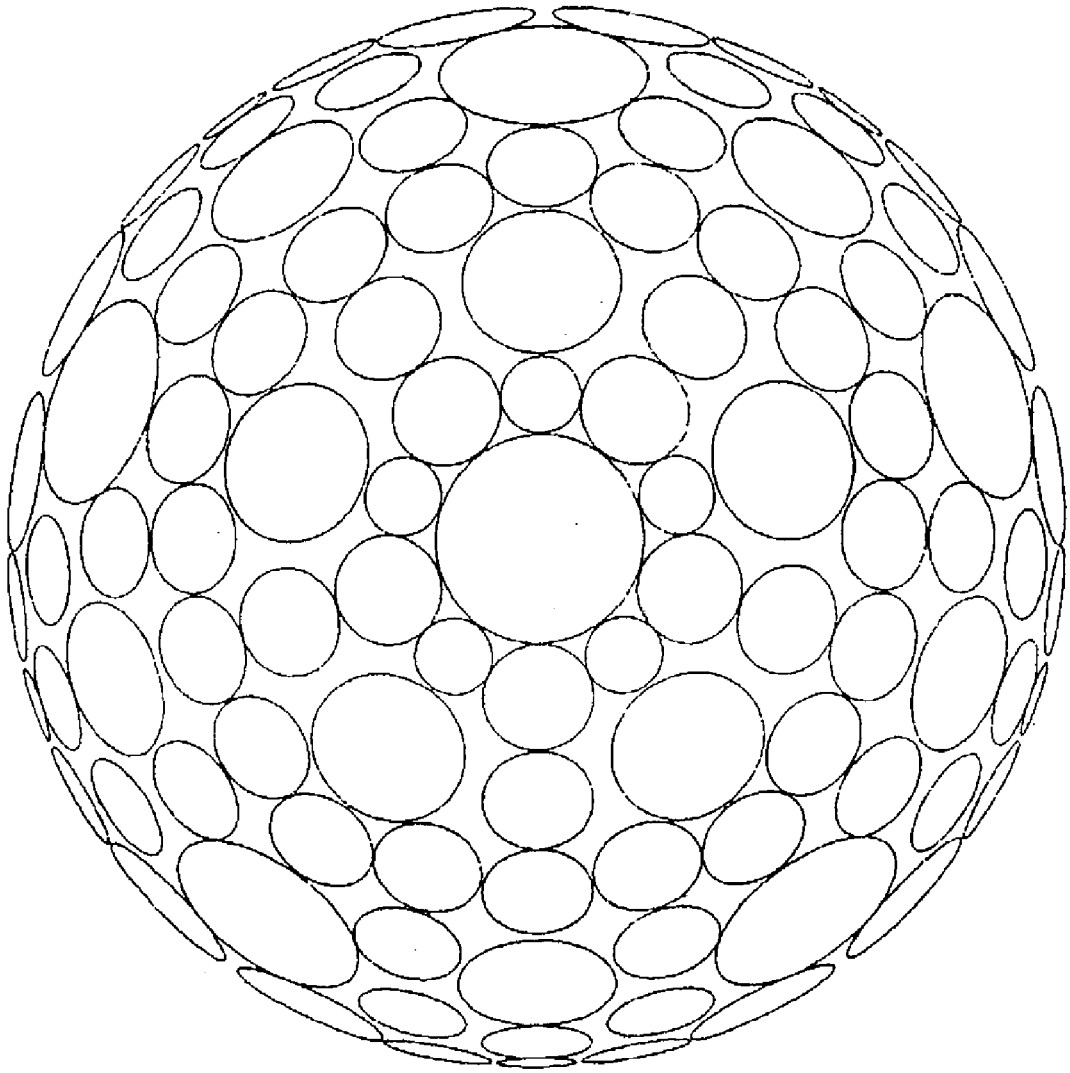
FIG. 20 is a plan view illustrating the golf ball according to Comparative Example 3 of the present invention.
Figure 21:
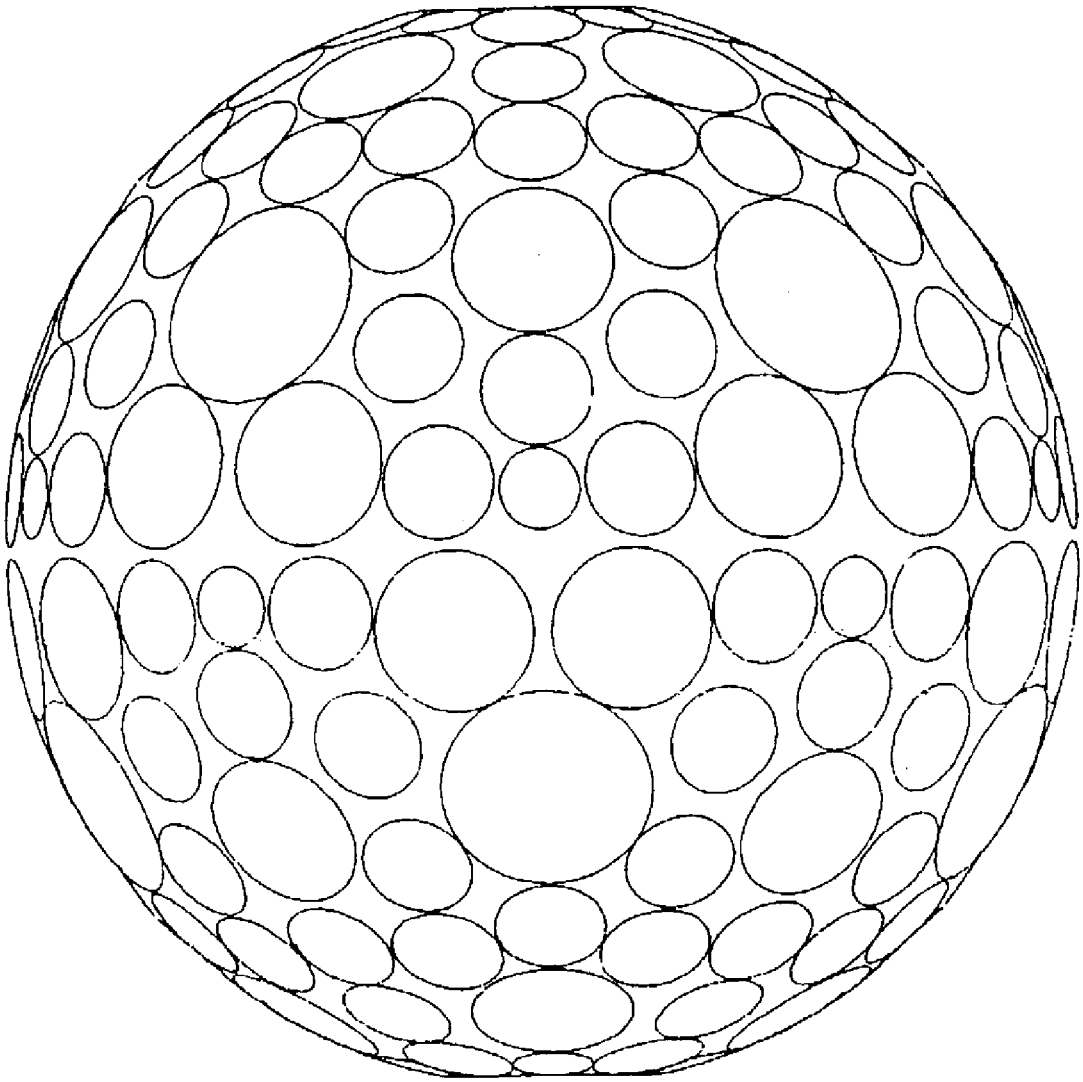
FIG. 21 is a front view illustrating the golf ball shown in FIG. 20.

In a similar manner to Example 1 except that specification of the dimples was specified as presented in Table 1 and Table 2 below by changing the mold, the golf ball of Examples 2 to 7 and Comparative Examples 1 to 3 was obtained. A plan view of the golf ball according to Example 2 is illustrated in FIG. 4, and a front view thereof is illustrated in FIG. 5. A plan view of the golf ball according to Example 3 is illustrated in FIG. 6, and a front view thereof is illustrated in FIG. 7. A plan view of the golf ball according to Example 4 is illustrated in FIG. 8, and a front view thereof is illustrated in FIG. 9. A plan view of the golf ball according to Example 5 is illustrated in FIG. 10, and a front view thereof is illustrated in FIG. 11. A plan view of the golf ball according to Example 6 is illustrated in FIG. 12, and a front view thereof is illustrated in FIG. 13. A plan view of the golf ball according to Example 7 is illustrated in FIG. 14, and a front view thereof is illustrated in FIG. 15. A plan view of the golf ball according to Comparative Example 1 is illustrated in FIG. 16, and a front view thereof is illustrated in FIG. 17. A plan view of the golf ball according to Comparative Example 2 is illustrated in FIG. 18, and a front view thereof is illustrated in FIG. 19. A plan view of the golf ball according to Comparative Example 3 is illustrated in FIG. 20, and a front view thereof is illustrated in FIG. 21.

TABLE 1

| | Specifications of Dimples | | | | | | | |
|---|---|---|---|---|---|---|---|---|
| | Type | Number-Ratio (%) | Diameter d (mm) | Depth (mm) | Volume v ($mm^3$) | Area s ($mm^2$) | Contour length x (mm) | Plan view Front view |
| Example 1 | A | 18-6.1 | 5.60 | 0.315 | 1.614 | 24.63 | 17.59 | FIG. 1 |
| | B | 102-34.7 | 5.10 | 0.281 | 1.307 | 20.43 | 16.02 | FIG. 2 |
| | C | 24-8.2 | 4.85 | 0.266 | 1.185 | 18.47 | 15.24 | |
| | D | 18-6.1 | 4.50 | 0.246 | 1.011 | 15.90 | 14.14 | |
| | E | 72-24.5 | 4.25 | 0.232 | 0.891 | 14.19 | 13.35 | |
| | F | 36-12.2 | 3.90 | 0.217 | 0.761 | 11.95 | 12.25 | |
| | G | 24-8.2 | 2.75 | 0.171 | 0.379 | 5.94 | 8.64 | |
| Example 2 | A | 80-27.8 | 6.20 | 0.360 | 2.020 | 30.19 | 19.48 | FIG. 4 |
| | B | 88-30.6 | 4.30 | 0.240 | 0.958 | 14.52 | 13.51 | FIG. 5 |
| | C | 80-27.8 | 3.50 | 0.204 | 0.634 | 9.62 | 11.00 | |
| | D | 40-13.9 | 2.50 | 0.168 | 0.324 | 4.91 | 7.85 | |
| Example 3 | A | 66-22.9 | 5.80 | 0.338 | 1.857 | 26.42 | 18.22 | FIG. 6 |
| | B | 78-27.1 | 4.40 | 0.249 | 1.027 | 15.21 | 13.82 | FIG. 7 |
| | C | 84-29.2 | 4.00 | 0.228 | 0.843 | 12.57 | 12.57 | |
| | D | 48-16.7 | 3.60 | 0.206 | 0.664 | 10.18 | 11.31 | |
| | E | 12-4.2 | 2.80 | 0.169 | 0.381 | 6.16 | 8.80 | |
| Example 4 | A | 72-22.5 | 6.00 | 0.344 | 1.876 | 28.27 | 18.85 | FIG. 8 |
| | B | 24-7.5 | 4.50 | 0.253 | 1.064 | 15.90 | 14.14 | FIG. 9 |
| | C | 88-27.5 | 4.00 | 0.228 | 0.843 | 12.57 | 12.57 | |
| | D | 112-35.0 | 3.30 | 0.201 | 0.588 | 8.55 | 10.37 | |
| | E | 24-7.5 | 2.70 | 0.174 | 0.377 | 5.73 | 8.48 | |
| Example 5 | A | 60-25.9 | 6.50 | 0.388 | 2.312 | 33.18 | 20.42 | FIG. 10 |
| | B | 72-31.0 | 4.80 | 0.280 | 1.309 | 18.10 | 15.08 | FIG. 11 |
| | C | 70-30.2 | 3.90 | 0.242 | 0.916 | 11.95 | 12.25 | |
| | D | 30-12.9 | 2.80 | 0.183 | 0.424 | 6.16 | 8.80 | |

TABLE 2

| | Specifications of Dimples | | | | | | | |
|---|---|---|---|---|---|---|---|---|
| | Type | Number-Ratio (%) | Diameter d (mm) | Depth (mm) | Volume v ($mm^3$) | Area s ($mm^2$) | Contour length x (mm) | Plan view Front view |
| Example 6 | A | 48-16.7 | 5.80 | 0.338 | 1.857 | 26.42 | 18.22 | FIG. 12 |
| | B | 96-33.3 | 4.40 | 0.257 | 1.088 | 15.21 | 13.82 | FIG. 13 |
| | C | 84-29.2 | 4.00 | 0.238 | 0.904 | 12.57 | 12.57 | |
| | D | 48-16.7 | 3.60 | 0.218 | 0.723 | 10.18 | 11.31 | |
| | E | 12-4.2 | 2.80 | 0.187 | 0.437 | 6.16 | 8.80 | |

TABLE 2-continued

| | Specifications of Dimples | | | | | | | |
|---|---|---|---|---|---|---|---|---|
| | Type | Number-Ratio (%) | Diameter d (mm) | Depth (mm) | Volume v ($mm^3$) | Area s ($mm^2$) | Contour length x (mm) | Plan view Front view |
| Example 7 | A | 60-31.3 | 7.10 | 0.455 | 3.127 | 39.59 | 22.31 | FIG. 14 |
| | B | 72-37.5 | 4.60 | 0.257 | 1.104 | 16.62 | 14.45 | FIG. 15 |
| | C | 60-31.3 | 3.90 | 0.209 | 0.713 | 11.95 | 12.25 | |
| Com. Example 1 | A | 66-22.9 | 5.20 | 0.306 | 1.567 | 21.24 | 16.34 | FIG. 16 |
| | B | 78-27.1 | 4.40 | 0.261 | 1.122 | 15.21 | 13.82 | FIG. 17 |
| | C | 84-29.2 | 4.00 | 0.241 | 0.924 | 12.57 | 12.57 | |
| | D | 48-16.7 | 3.60 | 0.224 | 0.756 | 10.18 | 11.31 | |
| | E | 12-4.2 | 2.80 | 0.187 | 0.437 | 6.16 | 8.80 | |
| Com. Example 2 | A | 132-30.6 | 4.10 | 0.239 | 0.931 | 13.20 | 12.88 | FIG. 18 |
| | B | 180-41.7 | 3.55 | 0.206 | 0.654 | 9.90 | 11.15 | FIG. 19 |
| | C | 60-13.9 | 3.40 | 0.200 | 0.601 | 9.08 | 10.68 | |
| | D | 60-13.9 | 3.25 | 0.195 | 0.553 | 8.30 | 10.21 | |
| Com. Example 3 | A | 12-5.9 | 8.50 | 0.548 | 3.420 | 56.75 | 26.70 | FIG. 20 |
| | B | 40-19.8 | 6.50 | 0.396 | 2.441 | 33.18 | 20.42 | FIG. 21 |
| | C | 130-64.6 | 4.60 | 0.272 | 1.228 | 16.62 | 14.45 | |
| | D | 20-9.9 | 3.20 | 0.203 | 0.578 | 8.04 | 10.05 | |

[Travel Distance Test]

A driver with a metal head (Sumitomo Rubber Industries, Ltd., "XXIOW#1", loft: 8°, hardness of shaft: X) was equipped with a swing machine (manufactured by True Temper Co.). Then the machine was conditioned to give the head speed of 49 m/sec, back spin rate immediately after the impact of about 3000 rpm, and launch angle of about 11°. Golf balls which had been kept the temperature of 23° C. were hit with this swing machine. Thus, carry (i.e., the distance from the launching point to the fall point), run (i.e., the distance from the fall point to the point where the ball stopped) and the total travel distance (i.e., the distance from the launching point to the point where the ball stopped) were measured. Mean values of data of the results from the measurement of 20 balls are shown in Table 3 below.

TABLE 3

| Results of Evaluation | | | | | | | | | | |
|---|---|---|---|---|---|---|---|---|---|---|
| | Example 1 | Example 2 | Example 3 | Example 4 | Example 5 | Example 6 | Example 7 | Comparative Example 1 | Comparative Example 2 | Comparative Example 3 |
| Diameter of golf ball D (mm) | 42.70 | 42.70 | 42.70 | 42.70 | 42.70 | 42.70 | 42.70 | 42.70 | 42.70 | 42.70 |
| Diameter of maximum dimple $d_{max}$ (mm) | 5.60 | 6.20 | 5.80 | 6.00 | 6.50 | 5.80 | 7.10 | 5.20 | 4.10 | 8.50 |
| Ratio R1 (%) *1 | 13.1 | 14.5 | 13.6 | 14.1 | 15.2 | 13.6 | 16.6 | 12.2 | 9.6 | 19.9 |
| Ratio R2 (%) *2 | 49.0 | 27.8 | 22.9 | 22.5 | 56.9 | 16.7 | 31.3 | 22.9 | 0.0 | 19.8 |
| Surface area occupation ratio Y (%) | 84.68 | 81.34 | 79.40 | 80.63 | 75.33 | 75.87 | 74.87 | 73.42 | 79.73 | 75.59 |
| Mean occupation ratio y (%) | 0.288 | 0.282 | 0.276 | 0.252 | 0.325 | 0.263 | 0.390 | 0.255 | 0.185 | 0.374 |
| Total contour length X (mm) | 4180.8 | 3940.8 | 3984.8 | 3130.7 | 3432.5 | 3905.6 | 3113.9 | 3860.4 | 4961.2 | 3217.0 |
| Total number of dimples N | 294 | 288 | 288 | 320 | 232 | 288 | 192 | 288 | 432 | 202 |
| Total volume ($mm^3$) | 634 | 684 | 620 | 634 | 688 | 588 | 770 | 559 | 496 | 760 |
| Carry (m) | 235.2 | 234.8 | 234.2 | 233.1 | 232.4 | 232.4 | 232.0 | 231.0 | 230.2 | 230.1 |
| Run (m) | 18.3 | 17.9 | 17.8 | 17.4 | 17.4 | 17.1 | 16.9 | 16.6 | 17.2 | 16.9 |
| Total (m) | 253.5 | 252.7 | 252.0 | 250.5 | 249.8 | 249.5 | 248.9 | 247.6 | 247.4 | 247.0 |

*1: Ratio of the diameter of maximum dimple $d_{max}$ to the diameter D of the golf ball

*2: Ratio of number of dimples having a diameter d accounting for 11.0% or greater and 18.0% or less of the diameter D, occupied in total number N of the dimples In Table 3, the golf ball of each of Examples exhibits greater travel distance than the golf ball of each of Comparative Examples. According to these results of evaluation, advantages of the present invention are clear.

The description herein above is just for illustrative examples, and therefore, various modifications can be made without departing from the principles of the present invention.

What is claimed is:

1. A golf ball comprising a large number of dimples on its surface, wherein a surface area occupation ratio Y of these dimples is equal to or greater than 75%, wherein a ratio R1 of the diameter of the maximum dimple $d_{max}$ to the diameter D of said golf ball is greater than 13.0% and 18.0% or less, and wherein a ratio R2 of number of dimples having a diameter d accounting for greater than 13.0% and 18.0% or less of said diameter D, occupied in total number N of the dimples is equal to or greater than 20%.

2. The golf ball according to claim 1 wherein a total number N of said dimples is equal to or less than 320.

3. The golf ball according to claim 2 wherein a total number N of said dimples is equal to or less than 310.

4. The golf ball according to claim 2 wherein a total number N of said dimples is equal to or less than 295.

5. The golf ball according to claim 2 wherein a total number N of said dimples is equal to or greater than 210.

6. The golf ball according to claim 1 wherein a mean occupation ratio y which is a value calculated by dividing said surface area occupation ratio Y by total number N of the dimples is equal to or greater than 0.22%.

7. The golf ball according to claim 6 wherein the mean occupation or ratio y is equal to or greater than 0.24%.

8. The golf ball according to claim 6 wherein the mean occupation or ratio y is equal to or greater than 0.28%.

9. The golf ball according to claim 6 wherein the mean occupation or ratio y is equal to or less than 0.40%.

10. The golf ball according to claim 1 wherein a summation X of the contour length x of said dimples and the surface area occupation ratio Y satisfy the relationship represented by the following formula (I):

$$X \leqq 38.82 \cdot y + 1495 \quad \text{(I)}.$$

11. The golf ball according to claim 10 wherein the summation X of the contour length x of said dimples and the surface area occupation ratio Y satisfy the relationship represented by the following formula (II):

$$X \leqq 38.82 \cdot y + 1445 \quad \text{(II)}.$$

12. The golf ball according to claim 10 wherein the summation X of the contour length x of said dimples and the surface area occupation ratio Y satisfy the relationship represented by the following formula (IV):

$$X \leqq 38.82 \cdot Y + 1085 \quad \text{(IV)}.$$

13. The golf ball according to claim 1 wherein a total number N of said dimples is equal to or less than 320.

14. The golf ball according to claim 13 wherein a mean occupation ratio y which is a value calculated by dividing said surface area occupation ratio Y by total number N of the dimples is equal to or greater than 0.22%.

15. The golf ball according to claim 14, wherein a summation X of the contour length x of said dimples and the surface area occupation ratio Y satisfy the relationship represented by the following formula (I):

$$X \leqq 38.82 \cdot Y + 1495 \quad \text{(I)}.$$

16. The golf ball according to claim 1 wherein the ratio R2 is equal to or greater than 22%.

17. The golf ball according to claim 1 wherein the ratio R2 is equal to or greater than 30%.

* * * * *